US009826310B2

(12) United States Patent
Higure et al.

(10) Patent No.: US 9,826,310 B2
(45) Date of Patent: Nov. 21, 2017

(54) LOUDSPEAKER DEVICE AND WIRELESS COMMUNICATION SYSTEM

(71) Applicant: Hitachi Kokusai Electric Inc., Minato-ku, Tokyo (JP)

(72) Inventors: Kinichi Higure, Kodaira (JP); Kunihito Kajihara, Kodaira (JP); Noriyuki Takahashi, Kodaira (JP)

(73) Assignee: Hitachi Kokusai Electric, Inc., Tokyo (JP)

( * ) Notice: Subject to any disclaimer, the term of this patent is extended or adjusted under 35 U.S.C. 154(b) by 0 days.

(21) Appl. No.: 15/467,219

(22) Filed: Mar. 23, 2017

(65) Prior Publication Data

US 2017/0195789 A1 Jul. 6, 2017

Related U.S. Application Data

(63) Continuation-in-part of application No. PCT/JP2015/071487, filed on Jul. 29, 2015.

(30) Foreign Application Priority Data

Sep. 29, 2014 (JP) ..... 2014-198715

(51) Int. Cl.
*H04R 29/00* (2006.01)
*H04R 3/00* (2006.01)
*H04R 1/02* (2006.01)

(52) U.S. Cl.
CPC ..... *H04R 3/007* (2013.01); *H04R 1/023* (2013.01); *H04R 29/001* (2013.01); *H04R 29/00* (2013.01); *H04R 29/008* (2013.01); *H04R 2430/03* (2013.01)

(58) Field of Classification Search
CPC .... H04R 29/00; H04R 29/001; H04R 29/008; H04R 1/023; H04R 3/007
USPC ..... 381/55, 58
See application file for complete search history.

(56) References Cited

U.S. PATENT DOCUMENTS 8,084,968 B2 * 12/2011 Murray ..... B06B 1/16 318/114
2013/0279710 A1 * 10/2013 Zhang ..... H04R 29/001 381/59
2016/0034416 A1 * 2/2016 Chavez ..... G06F 13/4295 381/59

FOREIGN PATENT DOCUMENTS

JP 2010-147893 A 7/2010
JP 2012-129704 A 7/2012

OTHER PUBLICATIONS

International Search Report from International Application No. PCT/JP2015/071487 dated Sep. 8, 2015.

* cited by examiner

*Primary Examiner* — Disler Paul
(74) *Attorney, Agent, or Firm* — Brundidge & Stanger, P.C.

(57) ABSTRACT

The present invention provides monitoring a sounding state of a speaker even in a case where any given sound is broadcast. In detecting the sounding state of the speaker with the microphone for sound detection, noises around the speaker are also collected by the microphone for sound detection. Therefore, in a case where there are ambient noises, it is difficult to monitor the sounding state of the speaker.

10 Claims, 9 Drawing Sheets

LOUDSPEAKER DEVICE AND WIRELESS COMMUNICATION SYSTEM

BACKGROUND

Technical Field

The present invention relates to a technique for monitoring whether a loudspeaker broadcast is normally performed or not by detecting vibration of a speaker of a loudspeaker device.

Related Art

For example, in a case where a broadcast content transmitted from a master station is broadcast by a speaker of an outdoor loudspeaker device, there is a method for detecting the sounding state of the speaker with a microphone for sound detection and accordingly monitoring whether the sounding state of the speaker is normal or not. A method has been suggested, in which a vibration sensor is used instead of the microphone for sound detection to detect the sounding state of the speaker, and it is compared with a vibration pattern stored in advance (for example, a vibration pattern such as a chime and the like), and a monitoring is performed to determine whether the sounding state of the speaker is normal or not (for example, see Patent Literature 1).

Patent Literature 1: JP 2010-147893 A

SUMMARY

In the method for detecting the sounding state of the speaker with the microphone for sound detection, noises around the speaker are also collected by the microphone for sound detection. Therefore, in a case where there are ambient noises, it is difficult to monitor the sounding state of the speaker. In the method using the vibration sensor, the vibration pattern of the sounding of a predetermined sound such as a chime and the output of the vibration sensor are compared, and therefore, when any given sound is broadcast, the sounding state of the speaker cannot be monitored.

It is an object of the present invention is to provide a technique capable of monitoring the sounding state of a speaker even in a case where any given sound is broadcast.

A typical configuration of a loudspeaker device according to the invention of the present application for solving the above problem is as follows. More specifically, a loudspeaker device including: a reception unit receiving a sound signal and outputting the received sound signal as a first sound signal; a sound amplification unit amplifying the first sound signal and outputting the amplified first sound signal as a second sound signal; a speaker for outputting a sound on the basis of the second sound signal; a vibration sensor attached to the speaker and detecting a vibration of the speaker to make an output as a vibration signal; and a determination unit performing fast Fourier transform (FFT) processing on the vibration signal to calculate a vibration power spectrum which is a frequency spectrum of a power of the vibration signal, performing FFT processing on a third sound signal based on the first sound signal to calculate a sound signal power spectrum which is a frequency spectrum of a power of the third sound signal, and determining whether the sound output from the speaker is normal or abnormal, on the basis of a correlation between the vibration power spectrum and the sound signal power spectrum.

A typical configuration of a wireless communication system according to the invention of the present application is as follows. More specifically, a wireless communication system including a first wireless transmission and reception device wirelessly transmitting a sound signal and a second wireless transmission and reception device receiving a sound signal wirelessly transmitted from the first wireless transmission and reception device and outputting a sound on the basis of the received sound signal, wherein the first wireless transmission and reception device includes: a display unit displaying various kinds of information; and a first wireless transmission and performing wireless transmission and reception to and from the second wireless transmission and reception device, wherein the second wireless transmission and reception device includes: a second wireless transmission and reception unit performing wireless transmission and reception to and from the first wireless transmission and reception device, and receiving a sound signal wirelessly transmitted from the first wireless transmission and reception device to output the received sound signal as a first sound signal; a sound amplification unit amplifying the first sound signal and outputting the amplified first sound signal as a second sound signal; a speaker for outputting a sound on the basis of the second sound signal; a vibration sensor attached to the speaker and detecting a vibration of the speaker to make an output as a vibration signal; and a determination unit performing FFT processing on the vibration signal to calculate a vibration power spectrum which is a frequency spectrum of a power of the vibration signal, performing FFT processing on a third sound signal based on the first sound signal to calculate a sound signal power spectrum which is a frequency spectrum of a power of the third sound signal, and determining whether the sound output from the speaker is normal or abnormal, on the basis of a correlation between the vibration power spectrum and the sound signal power spectrum, wherein when the first wireless transmission and reception device wirelessly transmits a sound signal to the second wireless transmission and reception device, the second wireless transmission and reception device receives a sound signal from the first wireless transmission and reception device, and in a case where a correlation between the vibration power spectrum and the sound signal power spectrum is small, the second wireless transmission and reception device wirelessly transmits, to the first wireless transmission and reception device, abnormal information indicating that the sound output from the speaker is abnormal, and when the first wireless transmission and reception device receives the abnormal information, the first wireless transmission and reception device displays, on the display unit, a content of the received abnormal information.

According to the above configuration, the sounding state of the speaker can be monitored even in a case where any given sound is broadcast.

DETAILED DESCRIPTION

First Embodiment

Figure 1:
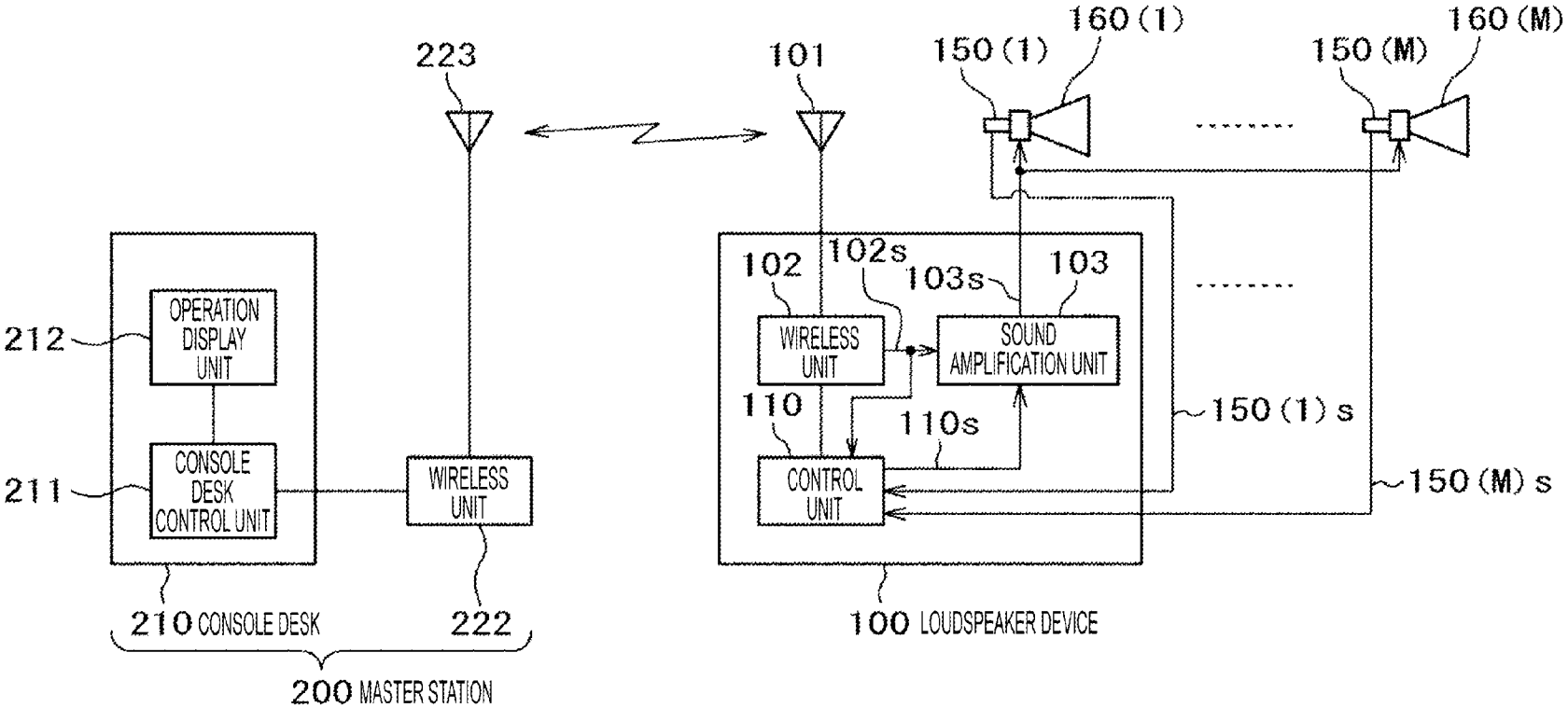
FIG. 1 is a configuration diagram of a wireless communication system according to a first embodiment of the present invention.

The first embodiment of the present invention will be explained. FIG. 1 is a configuration diagram illustrating a wireless communication system according to the first embodiment of the present invention. An example of FIG. 1 illustrates a schematic configuration of a municipal disaster prevention wireless system. This municipal disaster prevention wireless system is configured to include a master station 200 and a loudspeaker device 100. The example of FIG. 1 illustrates only one loudspeaker device 100, but there may be multiple loudspeaker devices 100. The loudspeaker device 100 is a slave station for receiving broadcast about disaster prevention information and the like from the master station 200 and amplifying and outputting the broadcast, and is, for example, installed outdoors.

The master station 200 wirelessly transmits disaster prevention information and the like to the loudspeaker device 100, and is configured to include a console desk 210, a wireless unit 222, and an antenna 223. The console desk 210 includes an operation display unit 212 and a console desk control unit 211. The operation display unit 212 includes an operation unit for receiving various kinds of commands and sound input from an operator and a display unit for displaying various kinds of information. The operation unit includes a microphone for sound input and multiple command buttons. The display unit includes a speaker for sound output and an LCD (Liquid Crystal Display). The example of FIG. 1 shows only one wireless unit 222, but there may be multiple wireless units 222.

The console desk control unit 211 controls various kinds of functions of the console desk 210, and is connected to the operation display unit 212 by signal line. When the operation display unit 212 receives a sound, the sound is output to the wireless unit 222 as a sound signal. The console desk control unit 211 displays, on the operation display unit 212, various kinds of information (sounding monitor result information and the like of the speaker) received from the loudspeaker device 100 via the wireless unit 222.

The wireless unit 222 is connected to the console desk control unit 211 by signal line. When the wireless unit 222 receives a sound signal from the console desk 210, the wireless unit 222 wirelessly transmits the received sound signal to the loudspeaker device 100. More specifically, the wireless unit 222 modulates a sound signal from the console desk control unit 211, and wirelessly transmits the sound signal via the antenna 223 to the loudspeaker device 100. The wireless unit 222 receives a radio wave from the loudspeaker device 100 via the antenna 223, demodulates the received reception signal, and outputs the received reception signal to the console desk control unit 211. The antenna 223 is an antenna for performing wireless transmission and reception to and from the loudspeaker device 100.

For example, in order to perform disaster prevention broadcast, a disaster prevention broadcast based on sound input from the operation display unit 212 is output to the wireless unit 222 via the console desk control unit 211. The wireless unit 222 emits, into the air via the antenna 223, a sound signal of disaster prevention broadcast received from the operation display unit 212, and more specifically, the wireless unit 222 wirelessly transmits the sound signal. The sound received from the operation display unit 212 may be a sound emitted by the operator, or may be a sound message previously stored in the operation display unit 212, or may be a combination thereof.

The loudspeaker device 100 is configured to include an antenna 101, a wireless unit 102, a sound amplification unit 103, a vibration sensor unit 150, a speaker 160, and a control unit 110. The antenna 101 is an antenna for performing wireless transmission and reception to and from the master station 200. In the example of FIG. 1, the loudspeaker device 100 includes M speakers 160(1) to 160(M) and M vibration sensor units 150(1) to 150(M). M denotes one or more positive integers, and indicates the number of speakers 160 attached to the loudspeaker device 100. The speakers 160(1) to 160(M) and the vibration sensor units 150(1) to 150(M) are collectively referred to as a speaker 160 and a vibration sensor unit 150, respectively.

The wireless unit 102 is configured to include a reception unit and a transmission unit, and is connected to the control unit 110 by signal line. The reception unit receives and demodulates a radio wave (for example, disaster prevention broadcast) from the master station 200 via the antenna 101, and outputs the demodulated sound signal to the control unit 110 and the sound amplification unit 103. The transmission unit modulates an information signal (for example, sounding monitor result information of the speaker 160) from the control unit 110, and wirelessly transmits the information signal to the master station 200 via the antenna 101. For example, the transmission unit wirelessly transmits sounding monitor result information of the speaker 160 to the master station 200 by using a response signal in reply to a polling signal from the master station 200.

The control unit 110 controls various kinds of functions of the loudspeaker device 100. It should be noted that the control unit 110 determines a broadcast start and a broadcast end in accordance with an existing method on the basis of a signal received by the wireless unit 102. The sound amplification unit 103 is connected to the wireless unit 102 and the control unit 110 by signal line, and amplifies the power of a sound signal 102*s* from the wireless unit 102 on the basis of a command from the control unit 110, and outputs the amplified sound signal 103*s* to the speaker 160. The speaker 160 is connected to the sound amplification unit 103 by signal line, and amplifies and outputs the sound signal 103*s* (i.e., outputs a sound on the basis of the sound signal 103*s*), and, for example, the speaker 160 uses a trumpet speaker.

The vibration sensor units 150(1) to 150(M) are attached to the speakers 160(1) to 160(M), respectively. The vibration sensor units 150(1) to 150(M) are connected to the control unit 110 by signal line, and the vibration sensor units 150(1) to 150(M) detect vibration states when sounds are made by the speakers 160(1) to 160(M), respectively, and outputs the vibration states to the control unit 110 as vibration signals 150(1)s to 150(M)s. The details of the vibration sensor unit 150 will be explained later in FIG. 3.

The control unit 110 also functions as a monitor unit for monitoring as to whether the speakers 160(1) to 160(M)

normally made sound or not on the basis of the vibration signals from the vibration sensor units 150(1) to 150(M) and the sound signals 102*s* of which powers have not yet been amplified by the sound amplification unit 103. Then, the monitor result is wirelessly transmitted from the wireless unit 102 to the master station 200. For example, abnormal information indicating that the sound outputs from any one of or all of the speakers 160(1) to 160(M) are abnormal is wirelessly transmitted to the master station 200. In a case where the speakers 160(1) to 160(M) normally make sound, normal information may be transmitted.

As a hardware configuration, each of the console desk control unit 211 and the control unit 110 of the loudspeaker device 100 includes a CPU (Central Processing Unit) and a memory for storing, e.g., an operation program and the like for each of them. The CPU operates in accordance with this operation program.

Figure 2:
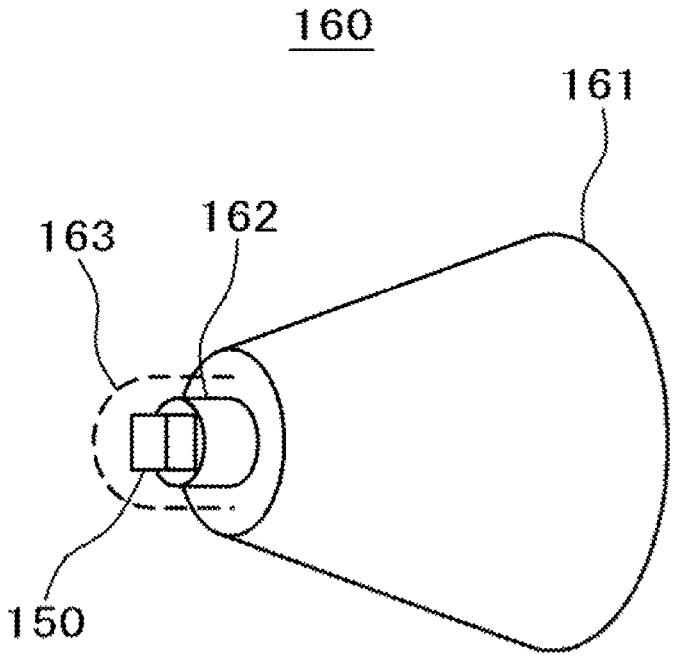
FIG. 2 is a figure illustrating an attachment state of a vibration sensor unit according to the first embodiment of the present invention.

FIG. 2 is a figure illustrating an attachment state of a vibration sensor unit according to an embodiment of the present invention. As illustrated in FIG. 2, the speaker 160 is configured to include a horn unit 161, a driver unit 162, and a protection cover 163. The driver unit 162 converts a sound signal 103*s*, i.e., an electric signal, to a mechanical vibration, and further converts the mechanical vibration into air vibration. The driver unit 162 is constituted by a coil, a vibration plate, and the like. The horn unit 161 radiates, in a predetermined limited direction, air vibration (i.e., sound) generated by the driver unit 162. The driver unit 162 and the horn unit 161 have a publicly-known configuration.

The vibration sensor unit 150 is attached so as to be in close contact with the driver unit 162, and detects vibration of the speaker 160 and outputs it as a vibration signal. In the example of FIG. 2, the vibration sensor unit 150 is attached at the outside and the rear of the driver unit 162. Alternatively, the vibration sensor unit 150 may be attached to the inside of the driver unit 162. In the example of FIG. 2, the vibration sensor unit 150 as well as the driver unit 162 are covered with a protection cover 163.

The protection cover 163 is provided to protect the vibration sensor unit 150 and the driver unit 162 from rains and hails. More specifically, when rains and hails collide with the vibration sensor unit 150 and the driver unit 162, the vibration sensor unit 150 and the driver unit 162 vibrate. However, the vibration sensor unit 150 and the driver unit 162 are covered with the protection cover 163, so that even when the rains and hails fall against the protection cover 163, the vibrations of the vibration sensor unit 150 and the driver unit 162 are suppressed, and therefore, the vibration sensor unit 150 and the driver unit 162 are less likely to be affected by rains and hails. When rains and hails collide against the horn unit 161, the horn unit 161 vibrates, but its vibration is not large enough to affect the vibration sensor unit 150.

In a case where the vibration sensor unit 150 is attached to the inside of the driver unit 162, the influence of rains and hails can be more greatly suppressed. However, it is troublesome to attach the vibration sensor unit 150 to the inside of the driver unit 162, and in some cases, it may be necessary to modify the driver unit 162.

In the first embodiment, the vibration sensor unit 150 is attached to the driver unit 162, but the vibration sensor unit 150 may be attached to anywhere as long as the vibration sensor unit 150 can detect sound vibration of the speaker 160. For example, the vibration sensor unit 150 may be provided at the front of the speaker 160 (in a passing point of a sound that is output), so that the vibration of the sound that is output from the speaker 160 is detected. As explained later, in the first embodiment, the sounding state of the speaker 160 is monitored by using a correlation coefficient between a vibration power spectrum and a sound signal power spectrum, and therefore, this can suppress problems associated with the use of a microphone for sound detection as described in the background art.

Figure 3:
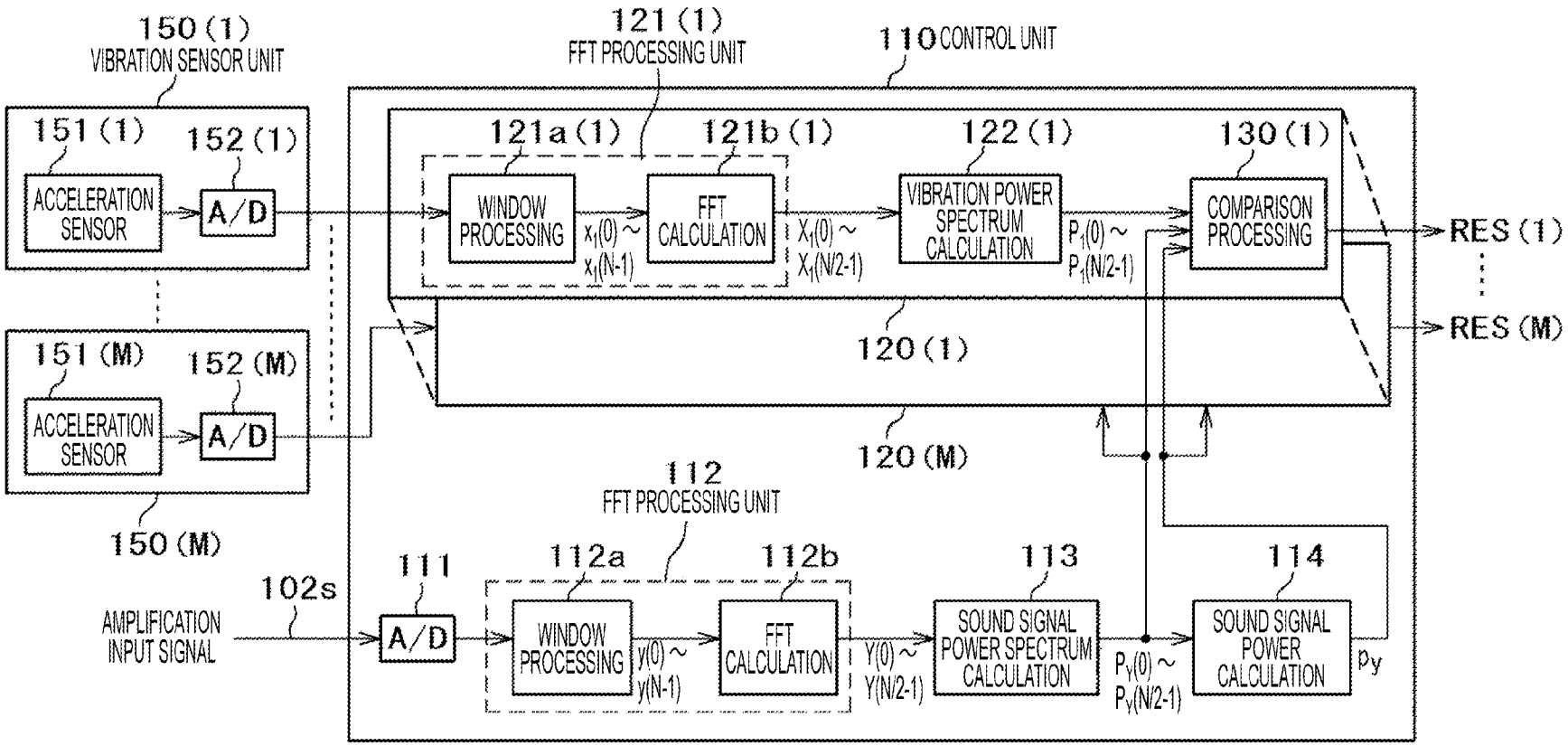
FIG. 3 is a configuration diagram illustrating the vibration sensor unit and a control unit according to the first embodiment of the present invention.

FIG. 3 is a configuration diagram illustrating a vibration sensor unit and a control unit according to the first embodiment of the present invention. As illustrated in FIG. 3, the vibration sensor units 150(1) to 150(M) are configured to include acceleration sensors 151(1) to 151(M) and A/D converters 152(1) to 152(M). The vibration sensor units 150(1) to 150(M) and the A/D converters 152(1) to 152(M) are collectively referred to as an acceleration sensor 151 and an A/D converter 152. The acceleration sensor 151 is publicly-known, and the acceleration sensor 151 detects acceleration of an object to which the acceleration sensor 151 is attached. For example, a three-dimensional acceleration sensor of an electrostatic capacitive detection method is used as the acceleration sensor 151. The A/D converter 152 converts a detection value (acceleration) of an acceleration sensor from an analog value to a digital value.

As described above, in the vibration sensor units 150(1) to 150(M), vibrations of the speakers 160(1) to 160(M) are detected by the acceleration sensors 151(1) to 151(M), and are converted by the A/D converters 152(1) to 152(M) into digital signals, which are output to channel processing units 120(1) to 120(M) in the control unit 110.

The control unit 110 is configured to include the channel processing units 120(1) to 120(M), an A/D converter 111, an FFT (Fast Fourier Transform) processing unit 112, a sound signal power spectrum calculation unit 113, and a sound signal power calculation unit 114. The FFT processing unit 112 is configured to include a window processing unit 112*a* and an FFT calculation unit 112*b*.

The channel processing units 120(1) to 120(M) perform comparison processing to compare vibration signals from the vibration sensor units 150(1) to 150(M), respectively, and the sound signal 110*s* of which power has not yet been amplified by the sound amplification unit 103. The channel processing units 120(1) to 120(M) are configured to include FFT processing units 121(1) to 121(M), vibration power spectrum calculation units 122(1) to 122(M), and comparison processing units 130(1) to 130(M), respectively. The FFT processing units 121(1) to 121(M) are configured to include window processing units 121*a*(1) to 121*a*(M) and FFT calculation units 121*b*(1) to 121*b*(M), respectively.

As described above, the channel processing unit 120(*k*) performs processing of a channel k, i.e., comparison processing based on an output of the vibration sensor unit 150(*k*). k means any one of 1 to M. All of the operations of the channel processing units 120(1) to 120(M) are the same. Therefore, the operation of the channel processing unit 120(*k*) will be explained.

The window processing unit 121*a*(*k*) performs window processing on a vibration signal which is a signal of acceleration that is output from the vibration sensor unit 150(*k*) (i.e., the vibration of the speaker 160(*k*)), and outputs samples $x_k(0)$ to $x_k(N-1)$, which are a window processing result, to the FFT calculation unit 121*b*(*k*). For example, a publicly-known Hamming window function is used for window processing. The purpose of the window processing is to prevent unnecessary high frequency component from being generated when FFT calculation is performed with an FFT calculation unit 121*b*(*k*) in a downstream stage.

A vibration signal, which is output from the vibration sensor unit 150(*k*), is processed in the window processing upon being divided into multiple time periods between the broadcast start and the broadcast end. More specifically, between the broadcast start and the broadcast end, the window processing is performed multiple times on the vibration signal. Then, in each time period in which the window processing is performed, N samples (window processing result) $x_k(0)$ to $x_k(N-1)$ are output from the window processing unit 121$a(k)$.

In this case, N is a positive integer (a power of 2), and is the number of samples for windowing. For example, where the vibration signal that is output from the vibration sensor unit 150$(k)$ includes 3200 (samples/s), and the time period in which a single window processing is performed (i.e., a time period divided by the window function) is 80 (ms), the number of samples N in a single window processing is N=80 (ms)×3200 (sample/s)=256.

It should be noted that the number of times the window processing is performed per unit time can be set to any number. For example, in a case where the window processing number is set to 10 (times/s), and the time from the broadcast start to the broadcast end is 20 (s), the window processing is performed 200 times from the broadcast start to the broadcast end.

In each of the time periods in which the window processing is performed, the FFT calculation unit 121$b(k)$ performs FFT (Fast Fourier Transform) operation on the samples $x_k(0)$ to $x_k(N-1)$ that are output from the window processing unit 121$a(k)$, and outputs frequency spectrums $X_k(0)$ to $X_k(N/2-1)$ of the vibration signal to the vibration power spectrum calculation unit 122$(k)$. Since the signal that is input into the FFT calculation unit 121$b(k)$ is a real number signal, $X_k(N/2)$ to $X_k(N-1)$ which are a latter half portion of the FFT operation result are redundant. Therefore, only the (N/2) frequency spectrums $X_k(0)$ to $X_k(N/2-1)$ which are the first half portion are used, and are output to the vibration power spectrum calculation unit 122$(k)$.

As described above, the FFT processing unit 121$(k)$ is configured to include a window processing unit 121$a(k)$ and an FFT calculation unit 121$b(k)$. More specifically, the FFT processing unit 121$(k)$ performs window processing and FFT operation as FFT processing.

The vibration power spectrum calculation unit 122$(k)$ squares each of the frequency spectrums $X_k(0)$ to $X_k(N/2-1)$ of the vibration signal, so that a vibration power spectrum Pk(n) which is a power of each frequency spectrum (i.e., a frequency spectrum of a power of the vibration signal) is calculated by the following (Expression 1), and is output to the comparison processing unit 130$(k)$.

$$Pk(n)=|X_k(n)|^2(n=0,1,\ldots,N/2-1) \quad \text{(Expression 1)}$$

At this occasion, the vibration power spectrum calculation unit 122$(k)$ preferably makes an output upon making $P_k(0)$ to $P_k(L)$ into zero in order to remove an unnecessary low frequency component from the vibration power spectrum Pk(n). More specifically, the vibration power spectrum calculation unit 122$(k)$ preferably outputs the vibration power spectrum ($P_k(L+1)$ to $P_k(N/2-1)$). L is a positive integer, and is a frequency number of a cut off frequency for removing the unnecessary low frequency component. More specifically, where fc is a cut off frequency, and fs is a sampling frequency, L=(fc/fs)N holds.

For example, let the cut off frequency fc be 300 Hz, let the sampling frequency fs be 3200 Hz as described above, and let N be 256. In this case, L is 24.

The reason why the low frequency component is removed in the vibration power spectrum calculation unit 122$(k)$ is that, in a sound output from the speaker 160, this low frequency component cannot be heard by people and is therefore unnecessary. Since the unnecessary low frequency component is removed, the amount of processing in the comparison processing unit 130$(k)$ in the downstream stage can be reduced.

In the example of FIG. 3, the unnecessary low frequency component is configured to be removed after the vibration power spectrum. Pk(n) is calculated. Alternatively, the unnecessary low frequency component may be configured to be removed before the vibration power spectrum Pk(n) is calculated. More specifically, immediately after the FFT calculation unit 121$b(k)$ outputs the frequency spectrums $X_k(0)$ to $X_k(N/2-1)$, $X_k(0)$ to $X_k(L)$ which is the unnecessary low frequency component may be configured to be removed.

As described above, the control unit 110 calculates the vibration frequency spectrum $X_K(n)$ which is a frequency spectrum of acceleration that is output from the vibration sensor unit 150$(k)$, and further, calculates the vibration power spectrum $P_k(n)$ on the basis of the vibration frequency spectrum $X_K(n)$. Then, as explained later, comparison processing with a sound signal frequency spectrum Y and a sound signal power spectrum $P_Y$ is performed, and RES(k) which is a result of the comparison processing is output.

The A/D converter 111 converts, into a digital signal, the sound signal (amplification input signal) 110$s$ of which power has not yet been amplified by the sound amplification unit 103. The window processing unit 112$a$ performs window processing on the sound signal converted into digital by the A/D converter 111, and outputs samples y(0) to y(N−1), which are a window processing result, to the FFT calculation unit 112$b$. For example, Hamming window function is used for the window processing just like the window processing of the vibration signal explained above, but other window function may also be used. The purpose of the window processing is to prevent an occurrence of an unnecessary high frequency component when the FFT operation is performed by the FFT calculation unit 112$b$ in a downstream stage.

Like the window processing of the vibration signal explained above, the sound signal that is output from the A/D converter 111 is processed in the window processing upon being divided into multiple time periods between the broadcast start and the broadcast end. At this occasion, the number of times the window processing is performed, a time for which a single window processing is performed, and the number of samples of the window processing result are configured in a manner similar to the window processing of the vibration signal explained above. The timing of the window processing is configured so that the vibration signal and the sound signal that is output from the A/D converter 111 correspond to each other. More specifically, the timing of the window processing is configured so that the vibration signal to be processed in the window processing and the sound signal to be processed in the window processing are based on the same sound signal received by the wireless unit 102.

As described above, the window processing is performed multiple times on the sound signal from the broadcast start to the broadcast end. In each time period in which the window processing is performed, N samples (window processing result) y (0) to y (N−1) are output from the window processing unit 112$a$.

As described in the explanation about the window processing unit 121$a(k)$ of the vibration signal, N is the number of samples the windowing is performed with a positive integer (square of 2). At this occasion, like the window processing unit 121$a(k)$, the sound signal that is output from the A/D converter 111 is assumed to includes 3200 (samples/s), and the time period in which a single window processing is performed is assumed to be 80 (ms). Then, in this case, the number of samples N in a single window processing of the sound signal is the same as, the number of samples N in a single window processing of the vibration signal, i.e., N=80 (ms)×3200 (sample/s)=256.

In each time period in which the window processing is performed, the FFT calculation unit 112*b* performs FFT operation on the samples y (0) to y (N−1) that are output from the window processing unit 112*a*, and outputs the frequency spectrums Y(0) to Y (N/2−1) of the sound signal to the sound signal power spectrum calculation unit 113. Since the signal that is input into the FFT calculation unit 112*b* is a real number signal, Y (N/2) to Y (N−1) which are a latter half portion of the FFT operation result are redundant. Therefore, only the (N/2) frequency spectrums Y(0) to Y (N/2−1) which are the first half portion are used.

As described above, the FFT processing unit 112 is configured to include the window processing unit 112*a* and the FFT calculation unit 112*b*. More specifically, the FFT processing unit 112 performs window processing and FFT operation as FFT processing.

The sound signal power spectrum calculation unit 113 squares the frequency spectrums Y (0) to Y (N/2−1) of the sound signal, so that a sound signal power spectrum $P_Y(n)$ which is a power of each frequency spectrum (i.e., a frequency spectrum of a power of the sound signal) is calculated by the following (Expression 2), and is output to the comparison processing unit 130(*k*) and the sound signal power calculation unit 114.

$$P_Y(n)=|Y(n)|^2(n=0,1,\ldots,N/2-1) \quad \text{(Expression 2)}$$

At this occasion, the sound signal power spectrum calculation unit 113 preferably makes an output upon making $P_Y(0)$ to $P_Y(L)$ into zero in order to remove an unnecessary low frequency component from the sound signal power spectrum $P_Y(n)$. More specifically, the sound signal power spectrum calculation unit 113 preferably outputs the sound signal power spectrum ($P_Y(L+1)$ to $P_Y(N/2-1)$). As described above, L is a frequency number of a cut off frequency for removing the unnecessary low frequency component.

As described in the explanation about the vibration power spectrum calculation unit 122, the reason why the low frequency component is removed in the sound signal power spectrum calculation unit 113 is that, in a sound output from the speaker 160, this low frequency component cannot be heard by people and is therefore unnecessary. Since the unnecessary low frequency component is removed, the amount of processing in the comparison processing unit 130(*k*) and the sound signal power calculation unit 114 in the downstream stage can be reduced.

In the example of FIG. 3, the unnecessary low frequency component is configured to be removed after the sound signal power spectrum $P_Y(n)$ is calculated. Alternatively, the unnecessary low frequency component may be configured to be removed before the sound signal power spectrum $P_Y(n)$ is calculated. More specifically, immediately after the FFT calculation unit 112*b* outputs the frequency spectrums Y(0) to Y(N/2−1), Y(0) to Y(L) which are the unnecessary low frequency components may be configured to be removed.

For each time period in which the window processing is performed, the sound signal power calculation unit 114 derives the sound signal power $p_y$ which is a power obtained by adding the sound signal power spectrums $P_Y(n)$ (i.e., $P_Y(0)$ to $P_Y(N/2-1)$) by using, for example, the following (Expression 3) to (Expression 6), and outputs the sound signal power $p_y$ to the comparison processing units 130(1) to 130(M). In the example of (Expression 3) to (Expression 6), the sound signal power $p_y$ is an average power of the sound signal power spectrums $P_Y(n)$. At this occasion, as described above, it is preferably a power obtained by removing the unnecessary low frequency component from the sound signal power spectrums $P_Y(n)$.

[Math. 1]

$$p_y = \frac{\sum_{m=0}^{N-1} |y(m)|^2}{N} \quad \text{(Expression 3)}$$

$$= \frac{\sum_{m=0}^{N-1} |Y(m)|^2}{N^2} \quad \text{(Expression 4)}$$

$$= \frac{2\sum_{m=0}^{N/2-1} |Y(m)|^2}{N^2} \quad \text{(Expression 5)}$$

$$= \frac{2\sum_{m=0}^{N/2-1} P_Y(m)}{N^2} \quad \text{(Expression 6)}$$

In this case, (Expression 4) can be derived from (Expression 3) in accordance with Parseval's theorem. (Expression 5) is derived as follows: since y(m) is a real number, |Y(0)| to |Y(N/2−1)| is equal to |Y(N/2)| to |Y(N−1)|, and accordingly, (Expression 5) can be derived from (Expression 4). (Expression 6) can be derived from (Expression 5) with (Expression 2).

Figure 4:
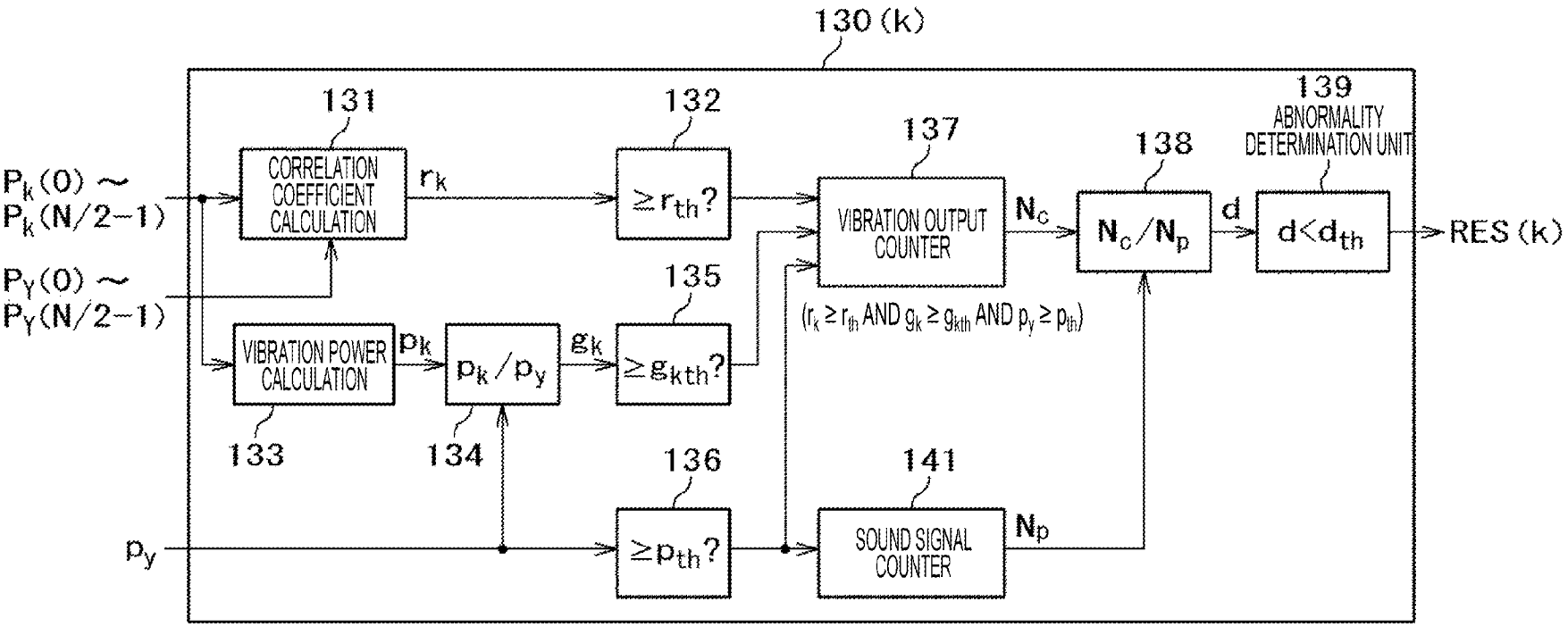
FIG. 4 is a configuration diagram illustrating a comparison processing unit according to the first embodiment of the present invention.

FIG. 4 is a configuration diagram illustrating the comparison processing units according to the first embodiment. Since all of the operations of the comparison processing units 130(1) to 130(M) are the same, the operation of the comparison processing unit 130(*k*) will be hereinafter explained. As described above, k means any one of 1 to M.

The comparison processing unit 130(*k*) is configured to include a correlation coefficient calculation unit 131, a correlation determination unit 132, a vibration power calculation unit 133, a divider 134, a power ratio determination unit 135, a sound signal power determination unit 136, a vibration output counter processing unit 137, a divider 138, an abnormality determination unit 139, and a sound signal counter processing unit 141.

For each time period in which the window processing is performed, the correlation coefficient calculation unit 131 outputs the degree of correlation between the vibration power spectrums $P_k(0)$ to $P_k(N/2-1)$ of the vibration signal from the vibration sensor unit 150(*k*) and the sound signal power spectrums $P_Y(0)$ to $P_Y(N/2-1)$. More specifically, for each time period in which the window processing is performed, the correlation coefficient calculation unit 131 calculates a correlation coefficient $r_k$ indicating the degree of correlation between the vibration power spectrums $P_k(0)$ to $P_k(N/2-1)$ and the sound signal power spectrums $P_Y(0)$ to $P_Y(N/2-1)$, and outputs the correlation coefficient $r_k$ to the correlation determination unit 132. The correlation coefficient $r_k$ is expressed by the following (Expression 7).

[Math. 2]

$$r_k = \frac{\sum_{m=0}^{N/2-1} P_k(m)P_Y(m)}{\sqrt{\sum_{m=0}^{N/2-1} |P_k(m)|^2 \sum_{m=0}^{N/2-1} |P_Y(m)|^2}} \quad \text{(Expression 7)}$$

For each time period in which the window processing is performed, the correlation determination unit 132 determines whether the degree of correlation calculated by the correlation coefficient calculation unit 131 is equal to or more than the degree of correlation that has been set in advance. More specifically, a determination is made as to whether the correlation coefficient $r_k$ is equal to or more than threshold value $r_{th}$ stored in the correlation determination unit 132 in advance, and in a case where the result is true (the correlation coefficient $r_k$ is equal to or more than the threshold value $r_{th}$) a value 1 is output to the vibration output counter processing unit 137, and in a case where the result is false (the correlation coefficient $r_k$ is less than the threshold value $r_{th}$), a value 0 is output to the vibration output counter processing unit 137. For example, the threshold value $r_{th}$ is set to about 0.8.

For each time period in which the window processing is performed, the vibration power calculation unit 133 derives the vibration power $p_k$ which is a power obtained by adding the vibration power spectrums $P_k(n)$ (i.e., $P_k(0)$ to $P_k(N/2-1)$) by using, for example, the following (Expression 8) to (Expression 11), and outputs the vibration power $p_k$ to the divider 134. In the example of (Expression 8) to (Expression 11), the vibration power $p_k$ is an average power of the vibration power spectrums $P_k(n)$. At this occasion, as described above, it is preferably a power obtained by removing the unnecessary low frequency component from the vibration power spectrums $P_k(n)$.

[Math. 3]

$$p_k = \frac{\sum_{m=0}^{N-1} |x_k(m)|^2}{N} \quad \text{(Expression 8)}$$

$$= \frac{\sum_{m=0}^{N-1} |X_k(m)|^2}{N^2} \quad \text{(Expression 9)}$$

$$= \frac{2\sum_{m=0}^{N/2-1} |X_k(m)|^2}{N^2} \quad \text{(Expression 10)}$$

$$= \frac{2\sum_{m=0}^{N/2-1} P_k(m)}{N^2} \quad \text{(Expression 11)}$$

In this case, (Expression 9) is derived from (Expression 8) in accordance with Parseval's theorem. Since $x_k(m)$ is a real number, $|X_k(0)|$ to $|X_k(N/2-1)|$ is the same as $|X_k(N/2)|$ to $|X_k(N-1)|$, and accordingly (Expression 10) is derived from (Expression 9). (Expression 11) is derived from (Expression 10) with (Expression 1).

For each time period in which the window processing is performed, the divider 134 divides the vibration power $p_k$, which is output from the vibration power calculation unit 133, by the sound signal power $p_y$, which is output from the sound signal power calculation unit 114, and outputs the power ratio of $p_k$ with respect to $p_y$, i.e., $g_k(g_k=p_k/p_y)$, to the power ratio determination unit 135.

For each time period in which the window processing is performed, the power ratio determination unit 135 determines whether the power ratio $g_k$ is equal to or more than a threshold value $g_{kth}$ stored in advance in the power ratio determination unit 135, and in a case where the result is true (the power ratio $g_k$ is equal to or more than the threshold value $g_{kth}$), a value 1 is output to the vibration output counter processing unit 137, and in a case where the result is false (the power ratio $g_k$ is less than the threshold value $g_{kth}$), a value 0 is output to the vibration output counter processing unit 137.

For each time period in which the window processing is performed, the sound signal power determination unit 136 determines whether the sound signal power $p_y$ is equal to or more than a threshold value $p_{th}$ stored in the sound signal power determination unit 136 in advance, and in a case where the result is true (the sound signal power $p_y$ is equal to or more than the threshold value $p_{th}$), a value 1 is output to the vibration output counter processing unit 137 and the sound signal counter processing unit 141, and in a case where the result is false (the sound signal power $p_y$ is less than the threshold value $p_{th}$), a value 0 is output to the vibration output counter processing unit 137 and the sound signal counter processing unit 141. For example, the threshold value $p_{th}$ is set to about 0.01.

The vibration output counter processing unit 137 resets an internal counter at the broadcast start. In a case where, for each time period in which the window processing is performed, the following (Expression 12) is satisfied (i.e., the value 1 is output from all of the correlation determination unit 132, the power ratio determination unit 135, and the sound signal power determination unit 136), the internal counter is increased (i.e. increased by one), and the counter value Nc is output to the divider 138. In a case where (Expression 12) is not satisfied, the internal counter is not increased.

$$r_k \geq r_{th} \text{ and } g_k \geq g_{kth} \text{ and } p_y \geq p_{th} \quad \text{(Expression 12)}$$

The sound signal counter processing unit 141 resets the internal counter at the broadcast start. Then, in a case where, for each time period in which the window processing is performed, the sound signal power $p_y$ is equal to or more than the threshold value $p_{th}(p_y \geq p_{th})$, the internal counter is increased, and the counter value Np is output to the divider 138. In a case where the sound signal power $p_y$ is less than the threshold value $p_{th}$, the internal counter is not increased.

The divider 138 calculates a counter ratio d (d=Nc/Np) which is a ratio of the counter value Nc with respect to the counter value Np after the broadcast end, and outputs the counter ratio d (d=Nc/Np) to the abnormality determination unit 139.

The abnormality determination unit 139 determines whether the counter ratio d is less than a threshold value $d_{th}$ stored in the abnormality determination unit 139 in advance after the broadcast end, and outputs the determination result. More specifically, in a case where the determination result is false (the counter ratio d is less than the threshold value $d_{th}$), the sounding result of the speaker 160 is determined to be abnormal, and the output RES(k) is set to a value 0. In a case where the determination result is true (the counter ratio d is equal to or more than the threshold value $d_{th}$), the sounding result of the speaker 160 is determined not to be abnormal, and the output RES(k) is set to the value 1. For example, the threshold value $d_{th}$ is set to about 0.25.

The control unit 110 determines whether the sounding results of the speakers 160(1) to 160(M) are abnormal or not on the basis of the RES(1) to RES(M) after the broadcast end. Then, the control unit 110 summarizes the determination result (for example, abnormal information indicating that the sounding result is abnormal), and wirelessly transmits the determination result from the wireless unit 102 to the master station 200. The master station 200 displays the sounding states of the speakers of each channel on, for example, the operation display unit 212 on the basis of the received determination result.

Alternatively, the control unit 110 adopts outputs of comparison processing units 130(1) to 130(M) after the broadcast end, i.e., RES(1) to RES(M) which are outputs of the channel processing units 120(1) to 120(M), as sounding monitor result information about the speakers 160(1) to 160(M), and wirelessly transmits the sounding monitor result information about the speakers 160(1) to 160(M) from the wireless unit 102 to the master station 200 in a collective manner. The master station 200 determines whether the sounding states of the speakers of each channel are abnormal or not on the basis of the received sounding monitor result information, and displays it on, for example, the operation display unit 212. The control unit 110 may store the determination result or the RES(1) to RES(M) in a memory.

As described above, the correlation determination unit 132 determines correlation between the vibration power spectrums $P_k(0)$ to $P_k(N/2-1)$ and the sound signal power spectrums $P_Y(0)$ to $P_Y(N/2-1)$, and more specifically, the correlation determination unit 132 determines correlation in the frequency between the vibration signal power and the sound signal power, and therefore, even when a waveform change due to group delay characteristics (i.e., a difference in the delay time due to the frequency) occurs in the sound amplification unit 103 and the speaker 160, correlation between the vibration signal and the sound signal can be determined and the sounding monitor of the speaker 160 can be realized.

When the master station 200 starts broadcasting, the loudspeaker device 100 receives the broadcast, and broadcasts the broadcast from the speaker 160. At this occasion, in the broadcast, in normal circumstances, a sound-present time period (a time period in which there is a sound) and a sound-absent time period (a time period in which there is not any sound) are alternately repeated. In the first embodiment, in the sound-present time period and the sound-absent time period, the vibration signal is output from the vibration sensor unit 150, and window processing, FFT operation, and power spectrum calculation are performed on the vibration signal. The window processing, the FFT operation, and the power spectrum calculation are also performed on the sound signal. However, in the sound-absent time period, the levels of the vibration signal and the sound signal are zero or extremely small, and therefore, it is meaningless to perform the sounding monitor of the speaker 160, and rather, there is a risk of falsely determining the sounding result of the speaker 160.

However, as described above, a condition that the sound signal power $p_y$ of the input sound signal 102*s* into the sound amplification unit 103 is equal to or more than the threshold value $p_{th}$ is adopted as a condition for increasing the counter of the vibration output counter processing unit 137, i.e., a condition for determining that the sounding state of the speaker 160 is normal. Therefore, the sound-absent section can be removed from the sounding monitor target section of the speaker 160. Therefore, this can reduce the chance of falsely determining the sounding result of the speaker 160, and can improve the determination precision, so that the amount of processing of the vibration output counter processing unit 137 can be alleviated.

As described above, a condition that the power ratio $g_k$ of the vibration power $p_k$ with respect to the sound signal power $p_y$ is equal to or more than the threshold value $g_{kth}$ is adopted as a condition for increasing the counter of the vibration output counter processing unit 137, i.e., a condition for determining that the sounding state of the speaker 160 is normal. For example, in a case of a malfunction such as, e.g., the sound signal is normal and the correlation coefficient $r_k$ is equal to or more than the threshold value $r_{th}$ but the speaker 160 cannot emit sound with a sufficiently large volume (i.e., cannot sufficiently vibrate the air), the power ratio $g_k$ is less than the threshold value $g_{kth}$. The cause of such malfunction is a lack of output of the sound amplification unit 103 and the speaker 160. Even in such malfunction, the sounding state of the speaker 160 can be determined to be abnormal, because the condition that the power ratio $g_k$ is equal to or more than the threshold value $g_{kth}$ is adopted as the condition for increasing the counter of the vibration output counter processing unit 137.

In a case where the speaker 160 itself has a manual volume setting function, the vibration power $p_k$ changes its magnitude in accordance with the volume setting of the speaker 160. Therefore, the threshold value $g_{kth}$ of the power ratio $g_k$ needs to change its magnitude in accordance with the volume setting of the speaker 160.

As described above, satisfying all of the following three conditions, i.e., the condition (1) that the correlation coefficient $r_k$ between the vibration power spectrum and the sound signal power spectrum is equal to or more than the threshold value $r_{th}$, the condition (2) that the power ratio $g_k$ of the vibration power $p_k$ with respect to the sound signal power $p_y$ is equal to or more than the threshold value $g_{kth}$, and the condition (3) that the sound signal power $p_y$ is equal to or more than the threshold value $p_{th}$ is adopted as a condition for increasing the counter of the vibration output counter processing unit 137, i.e., a condition for determining that the sounding state of the speaker 160 is normal. Therefore, the sounding state of the speaker can be more accurately monitored.

As described above, multiple time periods are provided between the broadcast start and the broadcast end, and for each of multiple time periods, the counter value Nc of the vibration output counter processing unit 137 and the counter value Np of the sound signal counter processing unit 141 are updated, and the sounding state of the speaker 160 is monitored in accordance with a ratio between Nc and Np. Therefore, even in a case of an intermittent malfunction in which the speaker 160 sometimes fails to output a sound, the precision of the malfunction detection can be increased.

In the first embodiment, the sound signal on which the FFT processing is performed by the FFT processing unit 112 is adopted as a sound signal prior to amplification with the sound amplification unit 103. As described above, even in a case where the sound amplification unit 103 malfunctions, the malfunction can be detected. More specifically, a malfunction of the sound amplification unit 103 can be detected by determining that the sounding state of the speaker 160 is abnormal. However, the sound signal on which the FFT processing is performed by the FFT processing unit 112 may be adopted as a sound signal that has been amplified by the sound amplification unit 103. Even in this case, the malfunction of the speaker 160 can also be detected even though the malfunction of the sound amplification unit 103 cannot be detected.

In the first embodiment, the abnormality determination unit 139 determines whether the counter ratio d (d=Nc/Np) is less than the threshold value $d_{th}$ or not after the broadcast end. However, when the counter value Np attains a predetermined number defined in advance without waiting for the broadcast end, a determination may be performed to determine whether the counter ratio d at that moment is less than a predetermined threshold value. Even in this case, the sounding state of the speaker 160 can be monitored.

In the first embodiment, satisfying the three of the conditions, i.e., the conditions (1) to (3), is adopted as the condition for determining that the sounding state of the speaker 160 is normal, but the condition (2) may be excluded, and only the condition (1) and the condition (3) may be adopted as a condition for determining the sounding state of the speaker 160. Even in this case, the sounding state of the speaker 160 can be monitored. This case will be explained in the second embodiment and the third embodiment.

Alternatively, the condition (3) may be excluded, and only the condition (1) and the condition (2) may be adopted as a condition for determining the sounding state of the speaker 160. Even in this case, the sounding state of the speaker can be monitored. This case will be explained in the fourth embodiment.

The condition (2) and the condition (3) may be excluded, and the condition (1) may be adopted as a condition for determining the sounding state of the speaker 160. Even in this case, the sounding state of the speaker can be monitored to a certain degree. This case will be explained in the fifth embodiment.

Second Embodiment

Subsequently, the second embodiment of the present invention will be explained. The second embodiment is a case where the condition (2) is excluded, and the condition (1) and the condition (3) are adopted as a condition for determining the sounding state of the speaker 160. The second embodiment is different from the first embodiment only in a configuration of a comparison processing unit 230 corresponding to the comparison processing unit 130 of the first embodiment (FIG. 4), and the configuration other than that is the same as the first embodiment. More specifically, FIG. 1 to FIG. 3 are configuration diagrams of the second embodiment.

Figure 5:
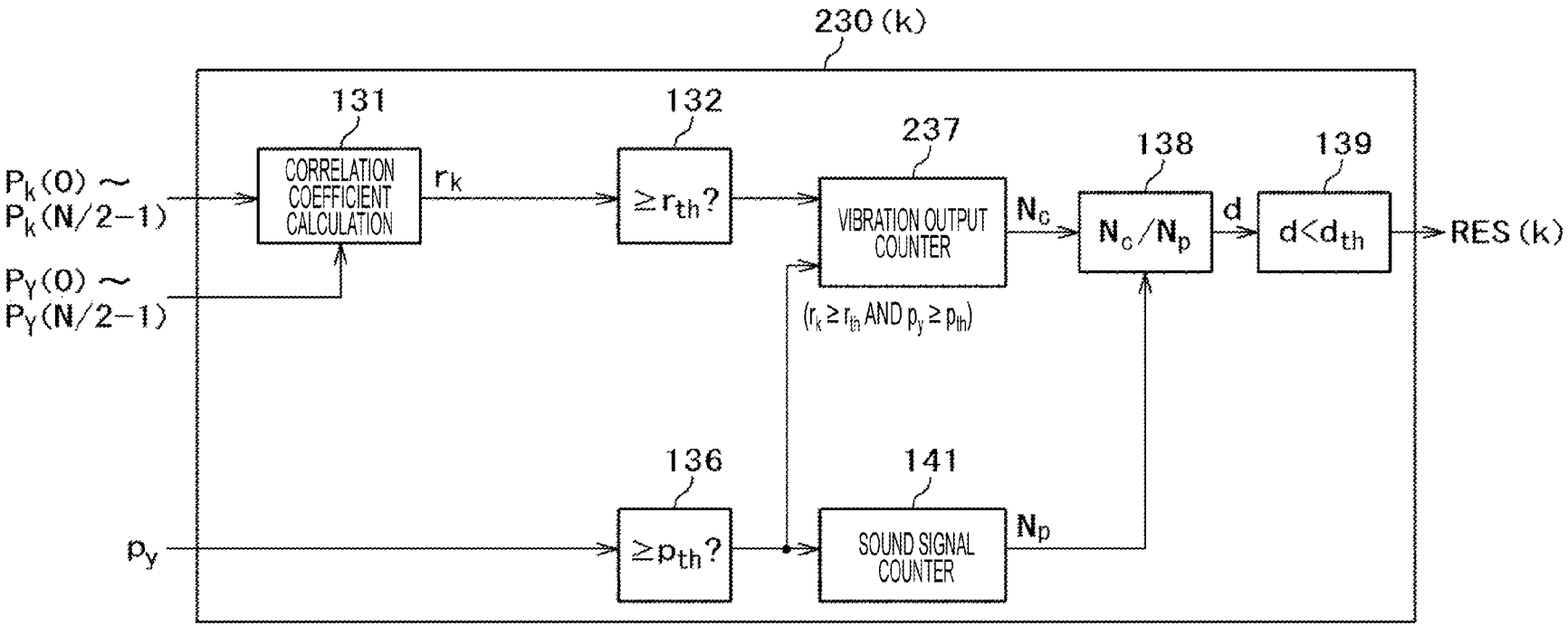
FIG. 5 is a configuration diagram illustrating a comparison processing unit according to a second embodiment of the present invention.

FIG. 5 is a configuration diagram of a comparison processing unit according to the second embodiment. The same elements as those of the first embodiment (FIG. 4) are denoted with the same reference numerals, and the explanation thereabout is omitted. The comparison processing unit 230(*k*) according to the second embodiment is configured to include a correlation coefficient calculation unit 131, a correlation determination unit 132, a sound signal power determination unit 136, a vibration output counter processing unit 237, a divider 138, an abnormality determination unit 139, and a sound signal counter processing unit 141. The comparison processing unit 230(*k*) means any one of the comparison processing units 230(1) to 230(M).

The vibration output counter processing unit 237 resets an internal counter at the broadcast start. In a case where, for each time period in which the window processing is performed, the following (Expression 13) is satisfied (i.e., the value 1 is output from all of the correlation determination unit 132 and the sound signal power determination unit 136), the internal counter is increased, and the counter value Nc is output to the divider 138. In a case where (Expression 13) is not satisfied, the internal counter is not increased.

$$r_k \geq r_{th} \text{ and } p_y \geq p_{th} \quad \text{(Expression 13)}$$

As described above, in the second embodiment, satisfying the following two conditions, i.e., the condition (1) that the correlation coefficient $r_k$ between the vibration power spectrum and the sound signal power spectrum is equal to or more than the threshold value $r_{th}$ and the condition (3) that the sound signal power $p_y$ is equal to or more than the threshold value $p_{th}$ is adopted as a condition for increasing the counter of the vibration output counter processing unit 137. Even in this case, the sounding state of the speaker can be monitored.

Third Embodiment

Subsequently, the third embodiment of the present invention will be explained. Like the second embodiment, the third embodiment is a case where the condition (2) is excluded, and the condition (1) and the condition (3) are adopted as a condition for determining the sounding state of the speaker 160. The third embodiment is different from the first embodiment only in a configuration of a comparison processing unit 330 corresponding to the comparison processing unit 130 of the first embodiment (FIG. 4), and the configuration other than that is the same as the first embodiment.

Figure 6:
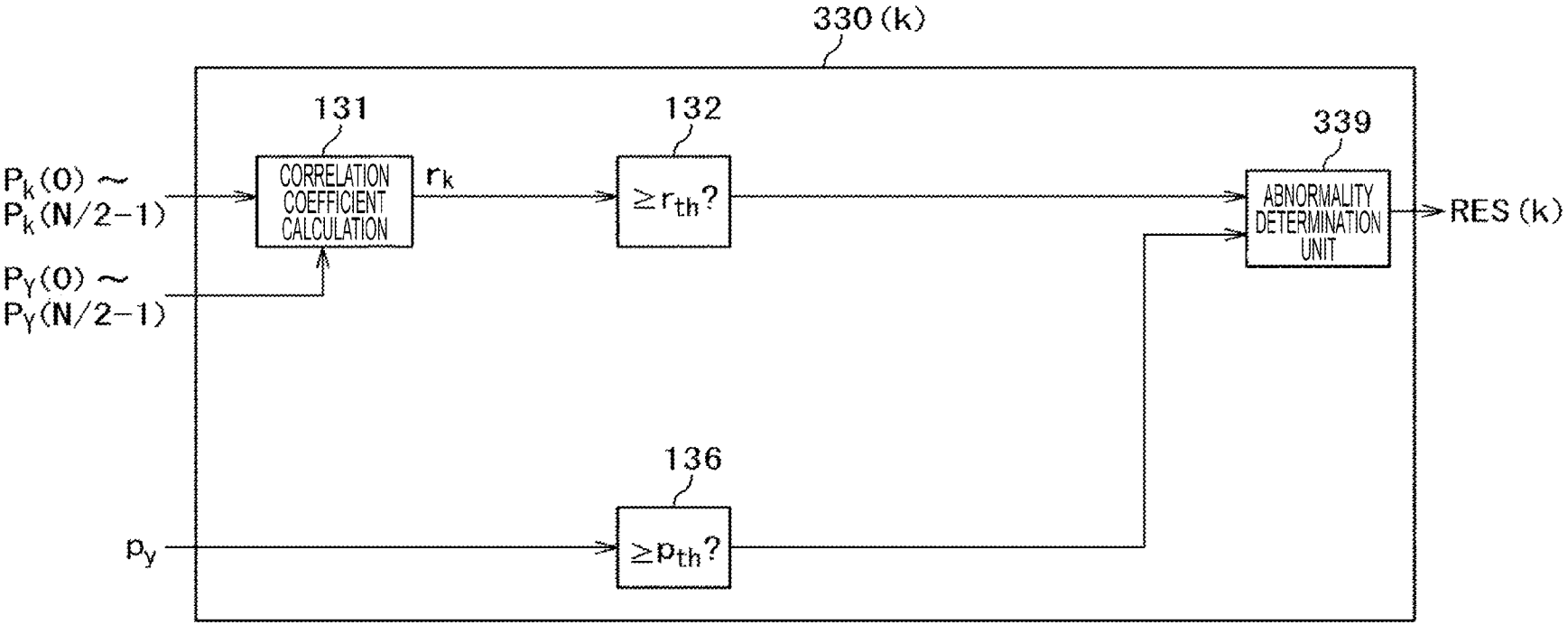
FIG. 6 is a configuration diagram illustrating a comparison processing unit according to a third embodiment of the present invention.

FIG. 6 is a configuration diagram according to the third embodiment. The same elements as those of the first embodiment (FIG. 4) are denoted with the same reference numerals, and the explanation thereabout is omitted. In the third embodiment, the comparison processing unit 330(*k*) is configured to include a correlation coefficient calculation unit 131, a correlation determination unit 132, a sound signal power determination unit 136, and an abnormality determination unit 339. The comparison processing unit 330(*k*) means any one of the comparison processing units 330(1) to 330(M).

Like the first and second embodiments, multiple time periods in which the window processing may be provided between the broadcast start and the broadcast end, but only one time period may be provided between the broadcast start and the broadcast end in the third embodiment. When multiple time periods in which the window processing is performed are provided, the precision for determining that the sounding of the speaker 160 is abnormal can be improved, which is preferable.

In the case where only one time period in which the window processing is performed is provided between the broadcast start and the broadcast end, a correlation determination result which is a determination result of the correlation determination unit 132 and a sound signal power determination result which is a determination result of the sound signal power determination unit 136 are output to the abnormality determination unit 339 between the broadcast start and the broadcast end. In a case where the sound signal power determination result is a value 1 (the sound signal power $p_y$ is equal to or more than the threshold value $p_{th}$) and the correlation determination result is a value 1 (the correlation coefficient $r_k$ is equal to or more than the threshold value $r_{th}$), the abnormality determination unit 339 determines that the sound output of the speaker 160 is normal, and makes the determination result RES(k) be a value 1, and outputs the determination result RES(k). In a case where the sound signal power determination result is a value 1, and the correlation determination result is a value 0 (the correlation coefficient $r_k$ is less than the threshold value $r_{th}$), the abnormality determination unit 339 determines that the sound output of the speaker 160 is abnormal, and makes the determination result RES(k) be a value 0, and outputs the determination result RES(k). In normal circumstances, the following case would not occur: the sound signal power determination result is a value 0 (the sound signal power $p_y$ is less than the threshold value $p_{th}$), and the correlation determination result is a value 1. However, if this case occurred, the abnormality determination unit 339 does not determine that the sound output of the speaker 160 is abnormal, makes the determination result RES(k) be a value 1, and outputs the determination result RES(k).

In a case where multiple time periods in which the window processing is performed are provided between the broadcast start and the broadcast end, each of the correlation determination result and the sound signal power determination result is output to the abnormality determination unit 339 for each of the time periods. For example, in a case where, between the broadcast start and the broadcast end, the number of times the sound signal power determination result is a value 1 and the correlation determination result is a value 0 is equal to or more than a predetermined threshold value, the abnormality determination unit 339 determines that the sound output of the speaker 160 is abnormal, and makes the determination result RES(k) be a value 0 and outputs the determination result RES(k).

In a case where, between the broadcast start and the broadcast end, the number of times the sound signal power determination result is a value 1 and the correlation determination result is a value 0 is less than the predetermined threshold value, the abnormality determination unit 339 determines that the sound output of the speaker 160 is normal, and makes the determination result RES(k) be a value 1 and outputs the determination result RES(k). The predetermined threshold value may be one or a number equal to or more than two. The smaller the predetermined threshold value is, the stricter the abnormality of the sounding of the speaker 160 is determined. As described above, in normal circumstances, the following case would not occur: the sound signal power determination result is a value 0 and the correlation determination result is a value 1. Therefore, this case is disregarded and the number of times of this case is not counted.

Alternatively, in a case where the number of times the sound signal power determination result is a value 1 and the correlation determination result is a value 0 is equal to or more than half of the number of time periods in which the window processing is performed, the abnormality determination unit 339 may determine that the sounding result of the speaker 160 has abnormality.

Like the first embodiment, after the broadcast end, the control unit 110 wirelessly transmits the outputs RES(1) to RES(M) of the comparison processing units 330(1) to 330(M) from the wireless unit 102 to the master station 200 in a collective manner. Alternatively, the control unit 110 determines whether the sounding result is abnormal or not on the basis of RES(1) to RES(M), and wirelessly transmits the sounding determination result from the wireless unit 102 to the master station 200 in a collective manner. The master station 200 displays information indicating whether the sounding states of the speakers of each channel are abnormal or not on, for example, the operation display unit 212 on the basis of the received RES(1) to RES(M) or the sounding determination result. The control unit 110 may store the outputs RES(1) to RES(M) or the sounding determination result in a memory.

Fourth Embodiment

Subsequently, the fourth embodiment according to the present invention will be explained. The fourth embodiment is a case where the condition (3) is excluded, and the condition (1) and the condition (2) are adopted as a condition for determining the sounding state of the speaker 160. The fourth embodiment is different from the first embodiment only in a configuration of a comparison processing unit 430 corresponding to the comparison processing unit 130 of the first embodiment (FIG. 4), and the configuration other than that is the same as the first embodiment.

Figure 7:
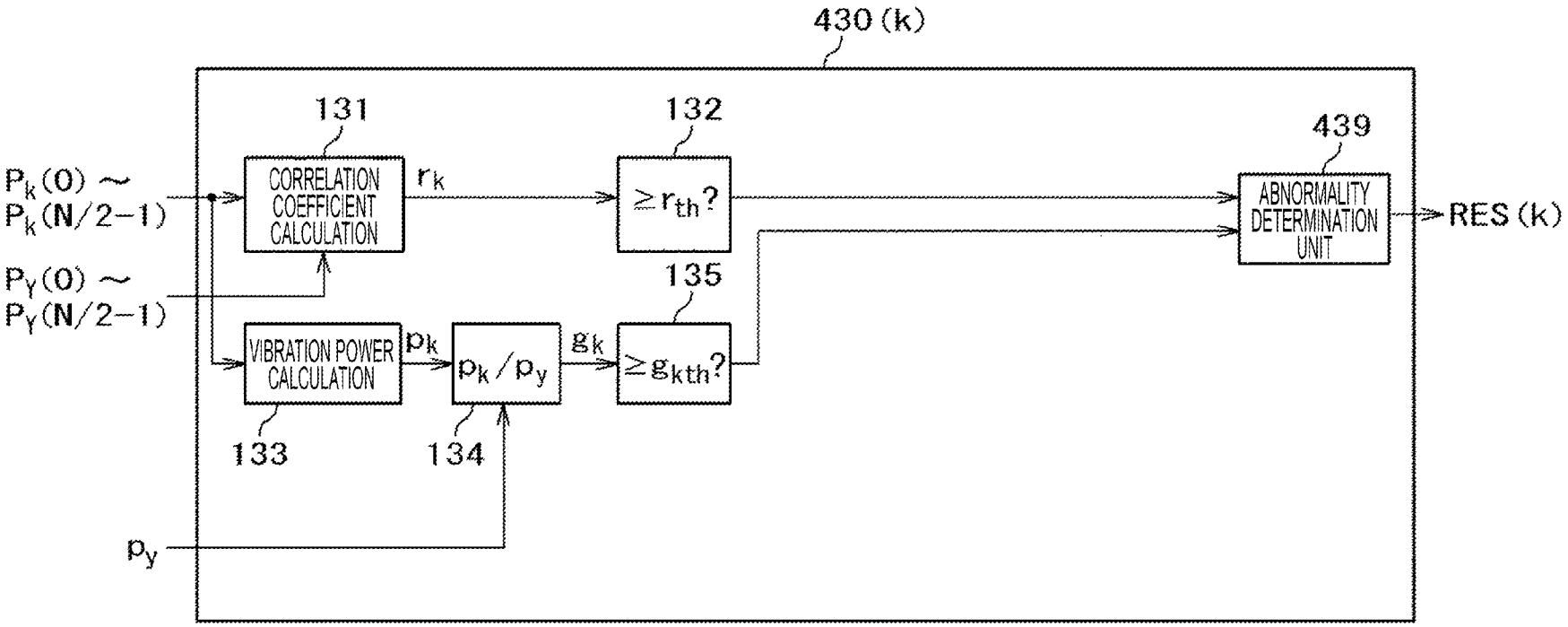
FIG. 7 is a configuration diagram illustrating a comparison processing unit according to a fourth embodiment of the present invention.

FIG. 7 is a configuration diagram illustrating a comparison processing unit according to the fourth embodiment. The same elements as those of the first embodiment (FIG. 4) are denoted with the same reference numerals, and the explanation thereabout is omitted. In the fourth embodiment, the comparison processing unit 430(*k*) is configured to include a correlation coefficient calculation unit 131, a correlation determination unit 132, a vibration power calculation unit 133, a divider 134, a power ratio determination unit 135, and an abnormality determination unit 439. The comparison processing unit 430(*k*) means any one of the comparison processing units 430(1) to 430(M).

As illustrated in FIG. 7, in the fourth embodiment, a correlation determination result which is an output of the correlation determination unit 132 and a power ratio determination result which is the output of the power ratio determination unit 135 are input into the abnormality determination unit 439. The abnormality determination unit 439 determines the sounding state of the speaker 160 on the basis of two conditions including the condition (1) that the correlation coefficient $r_k$ is equal to or more than the threshold value $r_{th}$ and the condition (2) that the power ratio $g_k$ is equal to or more than the threshold value a $g_{kth}$.

Like the first embodiment, multiple time periods in which the window processing is performed may be provided between the broadcast start and the broadcast end, but only one time period may be provided between the broadcast start and the broadcast end in the fourth embodiment. When multiple time periods in which the window processing is performed are provided, the precision for determining that the sounding of the speaker 160 is abnormal can be improved, which is preferable.

In the case where only one time period in which the window processing is performed is provided between the broadcast start and the broadcast end, each of a correlation determination result from the correlation determination unit 132 and a power ratio determination result from the power ratio determination unit 135 is output to the abnormality determination unit 439 between the broadcast start and the broadcast end. In a case where the correlation determination result is a value 1 (the correlation coefficient $r_k$ is equal to or more than the threshold value $r_{th}$) and the power ratio determination result is a value 1 (the power ratio $g_k$ is equal to or more than the threshold value $g_{kth}$), the abnormality determination unit 439 determines that the sound output of the speaker 160 is normal, and makes the determination result RES(k) be a value 1, and outputs the determination result RES(k). In a case where the correlation determination result is a value 1 and the power ratio determination result is a value 0 (the power ratio $g_k$ is less than the threshold value $g_{kth}$), the abnormality determination unit 439 determines that the sound output of the speaker 160 is abnormal, and makes the determination result RES(k) be a value 0, and outputs the determination result RES(k).

In normal circumstances, the following case would not occur: the correlation determination result is a value 0 (the correlation coefficient $r_k$ is less than the threshold value $r_{th}$) and the power ratio determination result is a value 1. However, if this case occurred, the abnormality determination unit 439 does not determine that the sound output of the speaker 160 is abnormal, and makes the determination result RES(k) be a value 1, and outputs the determination result RES(k). In a case where the correlation determination result is a value 0 and the power ratio determination result is a value 0, it is highly probably that there is no sound, and therefore, the abnormality determination unit 439 does not determine that the sound output of the speaker 160 is abnormal, and makes the determination result RES(k) be a value 1, and outputs the determination result RES(k).

In a case where multiple time periods in which the window processing is performed are provided between the broadcast start and the broadcast end, each of the correlation determination result and the power ratio determination result are output to the abnormality determination unit 439 for each of the time periods. For example, in a case where, between the broadcast start and the broadcast end, the number of times the correlation determination result is a value 1 and the power ratio determination result is a value 0 is equal to or more than a predetermined threshold value, the abnormality determination unit 439 determines that the sound output of the speaker 160 is abnormal, and makes the determination result RES(k) be a value 0 and outputs the determination result RES(k). In a case where, between the broadcast start and the broadcast end, the number of times the correlation determination result is a value 1 and the power ratio determination result is a value 0 is less than the predetermined threshold value, the abnormality determination unit 439 determines that the sound output of the speaker 160 is normal, and makes the determination result RES(k) be a value 1 and outputs the determination result RES(k). The predetermined threshold value may be one or a number equal to or more than two. The smaller the predetermined threshold value is, the stricter the abnormality of the sounding of the speaker 160 is determined.

Alternatively, in a case where the number of times the correlation determination result is a value 1 and the power ratio determination result is a value 0 is equal to or more than half of the number of time periods in which the window processing is performed, the abnormality determination unit 439 may determine that the sounding result of the speaker 160 has abnormality.

As described above, in normal circumstances, the following case would not occur: the correlation determination result is a value 0 and the power ratio determination result is a value 1. Therefore, this case is disregarded and the number of times of this case is not counted. Alternatively, in a case where the correlation determination result is a value 0 and the power ratio determination result is a value 0, it is highly probably that there is no sound, and therefore, the abnormality determination unit 439 does not determine that the sound output of the speaker 160 is abnormal. Therefore, this case is disregarded and the number of times of this case is not counted.

Like the first embodiment, the control unit 110 wirelessly transmits the outputs RES(1) to RES(M) of the comparison processing units 430(1) to 430(M) from the wireless unit 102 to the master station 200 in a collective manner. Alternatively, the control unit 110 determines whether the sounding result is abnormal or not on the basis of RES(1) to RES(M), and wirelessly transmits the sounding determination result from the wireless unit 102 to the master station 200 in a collective manner. The master station 200 displays information indicating whether the sounding states of the speakers of each channel are abnormal or not on, for example, the operation display unit 212 on the basis of the received RES(1) to RES(M) or the sounding determination result. The control unit 110 may store the outputs RES(1) to RES(M) or the sounding determination result in a memory.

As described above, in the fourth embodiment, satisfying the following two conditions, i.e., the condition (1) that the correlation coefficient $r_k$ between the vibration power spectrum and the sound signal power spectrum is equal to or more than the threshold value $r_{th}$ and the condition (2) that the power ratio $g_k$ of the vibration power $p_k$ with respect to the sound signal power $p_y$ is equal to or more than the threshold value $g_{kth}$ is adopted as a condition for determining the sounding state of the speaker 160. Even in this case, the sounding state of the speaker can be monitored, and, for example, a malfunction in which, e.g., the speaker cannot emit sound with a sufficiently large volume even though the sound signal is normal, can be detected.

Fifth Embodiment

Subsequently, the fifth embodiment according to the present invention will be explained. In the fifth embodiment, the condition (1) that the correlation coefficient $r_k$ is equal to or more than the threshold value $r_{th}$ is adopted as a condition for determining that the sounding state of the speaker 160 is normal. The fifth embodiment is different from the first embodiment only in a configuration of a comparison processing unit 530 corresponding to the comparison processing unit 130 of the first embodiment (FIG. 4), and the configuration other than that is the same as the first embodiment.

Figure 8:
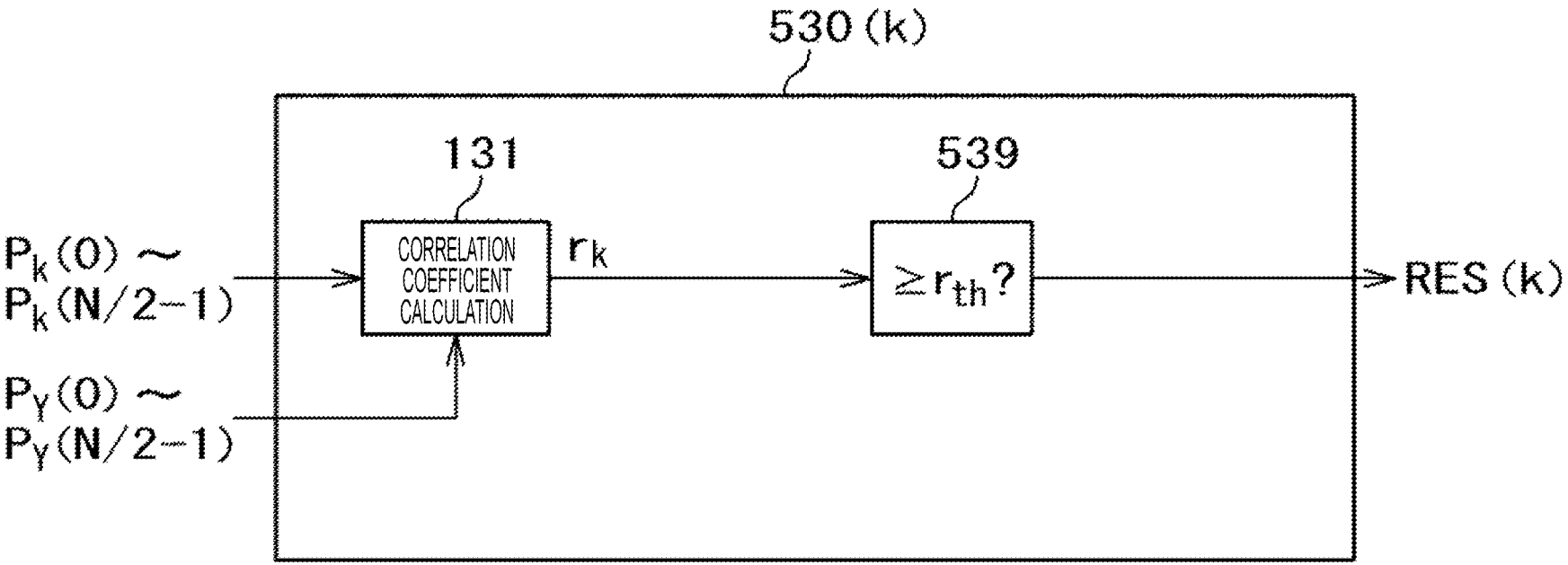
FIG. 8 is a configuration diagram illustrating a comparison processing unit according to a fifth embodiment of the present invention.

FIG. 8 is a configuration diagram illustrating a comparison processing unit according to the fifth embodiment. The same elements as those of the first embodiment (FIG. 4) are denoted with the same reference numerals, and the explanation thereabout is omitted. In the fifth embodiment, the comparison processing unit 530(*k*) is configured to include a correlation coefficient calculation unit 131 and an abnormality determination unit 539. The comparison processing unit 530(*k*) means any one of the comparison processing units 530(1) to 530(M).

Like the first embodiment, for each time period in which the window processing is performed, the correlation coefficient calculation unit 131 calculates a correlation coefficient $r_k$ indicating the degree of correlation between the vibration power spectrums $P_k(0)$ to $P_k(N/2-1)$ and the sound signal power spectrums $P_Y(0)$ to $P_Y(N/2-1)$, and outputs the correlation coefficient $r_k$ to the abnormality determination unit 539.

The abnormality determination unit 539 operates in the same manner as the correlation determination unit 132 according to the first embodiment. More specifically, for each time period in which the window processing is performed, a determination is made as to whether the correlation coefficient $r_k$ is equal to or more than a threshold value $r_{th}$ stored in the abnormality determination unit 539 in advance, and RES(k) which is a determination result is output.

Like the first embodiment, multiple time periods in which the window processing is performed may be provided between the broadcast start and the broadcast end, but only one time period may be provided between the broadcast start and the broadcast end in the fifth embodiment. When multiple time periods in which the window processing is performed are provided, the precision for determining that the sounding of the speaker 160 is abnormal can be improved, which is preferable.

In the case where only one time period in which the window processing is performed is provided between the broadcast start and the broadcast end, a single correlation coefficient $r_k$ from the correlation coefficient calculation unit 131 is output to the abnormality determination unit 539 between the broadcast start and the broadcast end. In a case where the correlation determination result is a value 1 (the correlation coefficient $r_k$ is equal to or more than the threshold value $r_{th}$), the abnormality determination unit 539 determines that the sound output of the speaker 160 is normal, and makes the determination result RES(k) be a value 1 and outputs the determination result RES(k). In a case where the correlation determination result is a value 0 (the correlation coefficient $r_k$ is less than the threshold value $r_{th}$), the abnormality determination unit 539 determines that the sound output of the speaker 160 is abnormal, and makes the determination result RES(k) be a value 0 and outputs the determination result RES(k).

In a case where multiple time periods in which the window processing is performed are provided between the broadcast start and the broadcast end, the correlation coefficient $r_k$ is output to the abnormality determination unit 539 for each of multiple time periods. In a case where the number of times the correlation determination result is a value 0 is equal to or more than a predetermined threshold value, the abnormality determination unit 539 determines that the sound output of the speaker 160 is abnormal, and makes the determination result RES(k) be a value 0 and outputs the determination result RES(k). In a case where the number of times the correlation determination result is a value 0 is less than the predetermined threshold value between the broadcast start and the broadcast end, the abnormality determination unit 539 determines that the sound output of the speaker 160 is normal, and makes the determination result RES(k) be a value 1 and outputs the determination result RES(k). The predetermined threshold value may be one or a number equal to or more than two. The smaller the predetermined threshold value is, the stricter the abnormality of the sounding of the speaker 160 is determined.

Alternatively, in a case where the number of times the correlation determination result is a value 0 is equal to or more than half of the number of time periods in which the window processing is performed, the abnormality determination unit 539 may determine that the sounding result of the speaker 160 has abnormality.

Like the first embodiment, the control unit 110 wirelessly transmits the outputs RES(1) to RES(M) of the comparison processing units 530(1) to 530(M) from the wireless unit 102 to the master station 200 in a collective manner. Alternatively, the control unit 110 determines whether the sounding result is abnormal or not on the basis of RES(1) to RES(M), and wirelessly transmits the sounding determination result from the wireless unit 102 to the master station 200 in a collective manner. The master station 200 displays information indicating whether the sounding states of the speakers of each channel are abnormal or not on, for example, the operation display unit 212 on the basis of the received RES(1) to RES(M) or the sounding determination result. The control unit 110 may store the outputs RES(1) to RES(M) or the sounding determination result in a memory.

As described above, in the fifth embodiment, the condition (1) as to whether the correlation coefficient $r_k$ is equal to or more than the threshold value $r_{th}$ is adopted as the condition for determining the sounding state of the speaker 160. Even in this case, the sounding state of the speaker can be monitored.

According to any one of the first to fifth embodiments, at least the effects shown below are achieved. (a) The loudspeaker device is configured to include the vibration sensor for detecting the vibration of the speaker and outputting the vibration signal, and the vibration signal is processed in the FFT processing, and the vibration power spectrum, i.e., a frequency spectrum of the power of the vibration signal, is calculated, and the sound signal is processed in the FFT processing, and the sound signal power spectrum, i.e., the frequency spectrum of the power of the sound signal, is calculated, and in a case where the correlation between the vibration power spectrum and the sound signal power spectrum is small, the sound output from the speaker is determined to be abnormal, so that it is not necessary to store a vibration pattern in advance, which is required in a conventional technique, and even in a case where any sound is broadcast, the sounding state of the speaker can be monitored. Since the power spectrums are compared, the correlation between the vibration signal and the sound signal can be determined even when there is a waveform change due to group delay characteristics in the sound amplification unit and the speaker, and the sounding state of the speaker can be monitored.

(b) The loudspeaker device is configured in such a manner that the correlation coefficient between the vibration power spectrum and the sound signal power spectrum is calculated, and a determination is made as to whether the correlation coefficient is equal to or more than the first value, and the sound signal power, i.e, the total power of the sound signal power spectrum, is calculated, and a determination is made as to whether the sound signal power is equal to or more than the second value, and in a case where the sound signal power is equal to or more than the second value and the correlation coefficient is less than the first value, the sound output from the speaker is determined to be abnormal, so that the sounding of the speaker can be monitored except the sound-absent section. Therefore, this can suppress false determination of the sounding result of the speaker.

(c) The loudspeaker device is configured in such a manner that, when the vibration signal is processed in the FFT processing, the vibration signal is divided into multiple time periods, the vibration power spectrum in each of the multiple time periods is calculated, and when the sound signal is processed in the FFT processing, the sound signal is divided into the multiple time periods, and the sound signal power spectrum in each of the multiple time periods is calculated, and a determination is made in each of the multiple time periods as to whether the correlation coefficient between the vibration power spectrum and the sound signal power spectrum is equal to or more than the first value or not, and a determination is made as to whether the sound signal power is equal to or more than the second value, and the number of times the correlation coefficient is equal to or more than the first value and the sound signal power is equal to or more than the second value is counted as a first number of times, and the number of times the sound signal power is equal to or more than the second value is counted as a second number of times, and in a case where a rate of the first number of times with respect to the second number of times is less than a predetermined threshold value, the sound output from the speaker is determined to be abnormal, so that the sounding of the speaker can be monitored except the sound-absent section, and the sounding state of the speaker can be monitored more accurately.

(d) The loudspeaker device is configured in such a manner that a determination is made as to whether, for each of the plurality of time periods, the vibration power ratio which is the rate of the vibration power with respect to the sound signal power is equal to or more than the third value or not, and in a case where the correlation coefficient is equal to or more than the first value and the sound signal power is equal to or more than the second value and the vibration power ratio is equal to or more than the third value, the first number of times is increased, so that a malfunction in which there is a correlation between the sound signal and the vibration signal and the speaker cannot emit sound with a sufficiently large volume even though the sound signal is normal can be detected, and the sounding state of the speaker can be monitored more accurately.

(e) The loudspeaker device is configured in such a manner that the speaker includes a driver unit for converting a sound signal into a mechanical vibration and a protection cover for protecting the vibration sensor, and the vibration sensor is attached to the driver unit, and the protection cover covers the vibration sensor and the driver unit, so that the vibration sensor can be attached easily, and the influence of rains and hails can be suppressed.

(f) The loudspeaker device is configured in such a manner that the first vibration sensor attached to the first speaker and the second vibration sensor attached to the second speaker are provided, and the vibration signal from the first vibration sensor is processed in the FFT processing to calculate the first vibration power spectrum, and the vibration signal from the second vibration sensor is processed in the FFT processing to calculate the second vibration power spectrum, and in a case where a correlation between the first vibration power spectrum and the sound signal power spectrum is determined to be small, the sound output from the first speaker is determined to be abnormal, and in a case where a correlation between the second vibration power spectrum and the sound signal power spectrum is determined to be small, the sound output from the second speaker is determined to be abnormal, so that even when there are two speakers, the sounding state of the speaker can be monitored.

(g) The loudspeaker device is configured in such a manner that the sound signal for calculating the sound signal power spectrum is the sound signal that has not yet been amplified by the sound amplification unit, so that not only abnormality of the speaker but also abnormality of the sound amplification unit can be monitored.

(h) The loudspeaker device is configured in such a manner that, when the correlation between the vibration power spectrum and the sound signal power spectrum is determined, the low frequency component thereof is removed, so that the processing for determining the correlation can be alleviated.

(i) A configuration is made in such a manner that the sounding abnormal information about the speaker is transmitted from the loudspeaker device to the master station, and is displayed on the master station, and therefore, whether the sounding of the speaker of the loudspeaker device is abnormal or not can be checked with the master station.

(j) A configuration is made in such a manner that the correlation coefficient between the vibration power spectrum and the sound signal power spectrum is calculated, and a determination is made as to whether the correlation coefficient is equal to or more than the first value, the vibration power which is the total power of the vibration power spectrums is calculated, and a determination is made as to whether the vibration power ratio, i.e., the rate of the vibration power with respect to the sound signal power, is equal to or more than the third value, and in a case where the correlation coefficient is equal to or more than the first value and the vibration power ratio is less than the third value, the sound output from the speaker is determined to be abnormal, so that a malfunction in which there is a correlation between the sound signal and the vibration signal and the speaker cannot emit sound with a sufficiently large volume even though the sound signal is normal can be detected.

(k) A configuration is made in such a manner that the broadcast start signal and the broadcast end signal are transmitted from the master station to the loudspeaker device, and in a case where the rate of the first number of times with respect to the second number of times is less than a predetermined threshold value after the loudspeaker device receives a broadcast start signal but before the loudspeaker device receives the broadcast end signal, the sound output from the speaker is determined to be abnormal, so that every time a broadcast from the master station to the loudspeaker device is performed, the sounding state of the speaker can be monitored.

The embodiments of the present invention have been hereinabove explained in a specific manner, but the present invention is not limited to the above embodiments, and the present invention can be changed in various manners without deviating from the gist thereof. For example, the embodiment explained the case in which the control unit 110 also functions as a determination unit for determining whether the sound output from the speaker 160 is normal or abnormal. Alternatively, the determination unit may be provided separately from the control unit 110 controlling each unit of the loudspeaker device 100. In the above embodiments, the control unit 110 determines whether the speaker 160 is operating normally or not on the basis of the vibration power spectrum, i.e., the frequency spectrum of the power of the vibration signal from the vibration sensor unit 150, and the sound signal power spectrum, i.e., the frequency spectrum of the power of the sound signal that has not yet been amplified by the sound amplification unit 103 that is output from the wireless unit 102. However, in the present invention, a determination may be made on the basis of the vibration power spectrum and the power spectrum of a sound signal based on at least the sound signal received by the wireless unit 102. The sound signal may be the sound signal 103*s* amplified by the sound amplification unit 103.

As a modification of the first embodiment explained above, the configuration as shown in FIG. 9 may be used. More specifically, comparison processing unit 130(*k*) may further include a vibration output power determination unit 142. For each time period in which the window processing is performed, the vibration output power determination unit 142 determines whether the vibration power pk that is output from the vibration power calculation unit 133 is equal to or more than the threshold value Pkth stored in advance in the vibration output power determination unit 142, and in a case where the result is true (the vibration output power pk is equal to or more than the threshold value Pkth), a value 1 is output to the vibration output counter processing unit 137, and in a case where the result is false (the vibration output power pk is less than the threshold value Pkth), a value 0 is output to the vibration output counter processing unit 137. The threshold value Pkth is set to, for example, about 0.01.

The vibration output counter processing unit 137 resets the internal counter at the broadcast start. Then, in a case where, for each time period in which the window processing is performed, the following (Expression 14) is satisfied (i.e., any one of the correlation determination unit 132 and the vibration output power determination unit 142 outputs a value 1, and all of the power ratio determination unit 135 and the sound signal power determination unit 136 output a value 1), the internal counter is increased (more specifically, one is added to the internal counter), and the counter value Nc is output to the divider 138. In a case where (Expression 14) is not satisfied, the internal counter is not increased.

$$(rk \geq rth \text{ or } pk \geq Pkth) \text{ and } gk \geq gkth \text{ and } py \geq pth \qquad \text{(Expression 14)}$$

As described above, satisfying all of the three conditions including the condition (1) that the correlation coefficient $r_k$ between the vibration power spectrum and the sound signal power spectrum is equal to or more than the threshold value $r_{th}$ or the vibration output power $p_k$ is equal to or more than the threshold value $P_{kth}$, the condition (2) that the power ratio $g_k$ of the vibration power $p_k$ with respect to the sound signal power $p_y$ is equal to or more than the threshold value $g_{kth}$, and the condition (3) that the sound signal power $p_y$ is equal to or more than the threshold value $p_{th}$ is adopted as the condition for increasing the counter of the vibration output counter processing unit 137, i.e., the condition for determining that the sounding state of the speaker 160 is normal. A criterion that the vibration output power $p_k$ is equal to or more than the threshold value $P_{kth}$ is also added as a logical addition to the condition (1), and therefore, in a case where, e.g., a correlation determination between the vibration power spectrum and the sound signal spectrum cannot be made due to a heavy rain, the sounding state can be determined based on the vibration output power.

Although the condition (1) is that the correlation coefficient rk between the vibration power spectrum and the sound signal power spectrum is equal to or more than the threshold value rth or the vibration output power pk is equal to or more than the threshold value Pkth, the condition (1) may be simply a criterion that the vibration output power pk is equal to or more than the threshold value Pkth. Even in this case, similar actions and effects can be obtained.

In the above first to the fifth embodiments, broadcast contents are wirelessly transmitted from the master station to the loudspeaker device, i.e., the slave station, but the present invention is not limited to the case where broadcast contents are wirelessly transmitted from the master station to the slave station. In general, the present invention can be applied to a case where a sound signal is wirelessly transmitted from a first wireless transmission and reception device to a second wireless transmission and reception device. The present invention can also be applied to a case where a sound signal is transmitted via wire from the first transmission and reception device to the second transmission and reception device.

The present invention can be understood as not only a device and a system for executing the processing according to the present invention but also, e.g., a method or a program for realizing such method and system and a recording medium recorded with such program. The present invention may be configured so that a CPU performs control by executing a control program stored in the memory, or may be configured as a hardware circuit.

This specification at least includes the following configurations.

(Configuration 1)

A loudspeaker device including:

a reception unit receiving a sound signal and outputting the received sound signal as a first sound signal;

a sound amplification unit amplifying the first sound signal and outputting the amplified first sound signal as a second sound signal;

a speaker for outputting a sound on the basis of the second sound signal;

a vibration sensor attached to the speaker and detecting a vibration of the speaker to make an output as a vibration signal; and a determination unit performing FFT processing on the vibration signal to calculate a vibration power spectrum which is a frequency spectrum of a power of the vibration signal, performing FFT processing on a third sound signal based on the first sound signal to calculate a sound signal power spectrum which is a frequency spectrum of a power of the third sound signal, and determining whether the sound output from the speaker is normal or abnormal, on the basis of a correlation between the vibration power spectrum and the sound signal power spectrum.

(Configuration 2)

The loudspeaker device according to configuration 1, wherein the determination unit includes:

a correlation coefficient calculation unit calculating a correlation coefficient between the vibration power spectrum and the sound signal power spectrum;

a correlation determination unit determining whether the correlation coefficient is equal to or more than a first value;

a sound signal power calculation unit calculating a sound signal power which is a total power of the sound signal power spectrum; and a sound signal power determination unit determining whether the sound signal power is equal to or more than a second value, wherein in a case where the sound signal power is equal to or more than the second value, and the correlation coefficient is less than the first value, the sound output from the speaker is determined to be abnormal.

(Configuration 3)

The loudspeaker device according to configuration 2, wherein the determination unit divides the vibration signal into a plurality of time periods when the FFT processing is performed on the vibration signal, calculates the vibration power spectrum for each of the plurality of time periods, divides the third sound signal into a plurality of time periods when the FFT processing is performed on the third sound signal, and calculates the sound signal power spectrum for each of the plurality of time periods, the correlation coefficient calculation unit calculates the correlation coefficient for each of the plurality of time periods, the sound signal power calculation unit calculates the sound signal power for each of the plurality of time periods, a number of times the correlation coefficient is equal to or more than the first value and the sound signal power is equal to or more than the second value is counted as a first number of times, a number of times the sound signal power is equal to or more than the second value is counted as a second number of times, and in a case where a rate of the first number of times with respect to the second number of times is less than a predetermined threshold value, the sound output from the speaker is determined to be abnormal.

(Configuration 4)

The loudspeaker device according to configuration 3, wherein the determination unit includes:

a vibration power calculation unit calculating, for each of the plurality of time periods, a vibration power which is a total power of the vibration power spectrum of each of the time periods; and a power ratio determination unit for determining whether a vibration power ratio, which is a rate of the vibration power with respect to the sound signal power, is equal to or more than a third value, in a case where the correlation coefficient is equal to or more than the first value, and where the sound signal power is equal to or more than the second value, and where the vibration power ratio is equal to or more than the third value, the first number of times is increased.

(Configuration 5)

The loudspeaker device according to configuration 1, wherein the speaker includes:

a driver unit converting a sound signal into a mechanical vibration; and a protection cover protecting the vibration sensor, wherein the vibration sensor is attached to the driver unit, and the protection cover covers the vibration sensor and the driver unit.

(Configuration 6)

The loudspeaker device according to configuration 1, wherein a first speaker and a second speaker are provided as the speaker, and a first vibration sensor attached to the first speaker and a second vibration sensor attached to the second speaker are provided as the vibration sensor, the determination unit includes:

a first vibration power spectrum calculation unit performing FFT processing on the vibration signal from the first vibration sensor, and calculating the vibration power spectrum as a first vibration power spectrum; and a second vibration power spectrum calculation unit performing FFT processing on the vibration signal from the second vibration sensor, and calculating the vibration power spectrum as a second vibration power spectrum, wherein in a case where a correlation between the first vibration power spectrum and the sound signal power spectrum is determined to be small, a sound output from the first speaker is determined to be abnormal, and in a case where a correlation between the second vibration power spectrum and the sound signal power spectrum is determined to be small, a sound output from the second speaker is determined to be abnormal.

(Configuration 7)

The loudspeaker device according to configuration 1, wherein the third sound signal is a sound signal before amplification with the sound amplification unit.

(Configuration 8)

The loudspeaker device as described in the configuration 1, characterized in that the third sound signal is a sound signal amplified by the sound amplification unit.

(Configuration 9)

The loudspeaker device as described in the configuration 1, characterized in that when the correlation between the vibration power spectrum and the sound signal power spectrum is determined, the determination unit removes the low frequency component thereof.

(Configuration 10)

The loudspeaker device according to configuration 1, wherein the determination unit includes:

a correlation coefficient calculation unit calculating a correlation coefficient between the vibration power spectrum and the sound signal power spectrum;

a correlation determination unit determining whether the correlation coefficient is equal to or more than a first value;

a sound signal power calculation unit calculating a sound signal power which is a total power of the sound signal power spectrum;

a vibration power calculation unit calculating a vibration power which is a total power of the vibration power spectrum; and a power ratio determination unit determining whether a vibration power ratio, which is a rate of the vibration power with respect to the sound signal power, is equal to or more than a third value, wherein in a case where the correlation coefficient is equal to or more than the first value and where the vibration power ratio is less than the third value, the sound output from the speaker is determined to be abnormal.

(Configuration 11)

The loudspeaker device as described in the configuration 1, characterized in that when the vibration signal is processed in the FFT processing, the determination unit divides the vibration signal into multiple time periods, and calculates the vibration power spectrum for each of the multiple time periods, when the third sound signal is processed in the FFT processing, the determination unit divides the third sound signal into the multiple time periods, and calculates the sound signal power spectrum for each of the multiple time periods, the loudspeaker device includes:

a correlation coefficient calculation unit calculating, in each of the multiple time periods, a correlation coefficient between the vibration power spectrum and the sound signal power spectrum;

a correlation determination unit determining whether the correlation coefficient is equal to or more than the first value or not;

a sound signal power calculation unit calculating, for each of the plurality of time periods, a sound signal power which is the total power of the sound signal power spectrum of each of the time periods;

a sound signal power determination unit determining whether the sound signal power is equal to or more than the second value or not;

a vibration output counter processing unit counting a number of times the correlation coefficient is equal to or more than the first value and the sound signal power is equal to or more than the second value, and outputs it as a first number of times; and a sound signal counter processing unit counting a number of times the sound signal power is equal to or more than the second value, and outputs it as a second number of times, and in a case where the rate of the first number of times with respect to the second number of times is less than a predetermined threshold value, the sound output from the speaker is determined to be abnormal.

(Configuration 12)

A wireless communication system including:

a first wireless transmission and reception device wirelessly transmitting a sound signal; and a second wireless transmission and reception device receiving a sound signal wirelessly transmitted from the first wireless transmission and reception device, and outputting a sound based on the received sound signal, wherein the first wireless transmission and reception device includes:

a display unit displaying various kinds of information; and a first wireless transmission and reception unit performing wireless transmission and reception to and from the second wireless transmission and reception device, wherein the second wireless transmission and reception device includes:

a second wireless transmission and reception unit performing wireless transmission and reception to and from the first wireless transmission and reception device, receiving a sound signal wirelessly transmitted from the first wireless transmission and reception device, and outputting it as a first sound signal;

a sound amplification unit amplifying the first sound signal and outputting it as a second sound signal;

a speaker outputting a sound based on the second sound signal;

a vibration sensor attached to the speaker and detecting a vibration of the speaker to make an output as a vibration signal;

a determination unit performing FFT processing on the vibration signal to calculate a vibration power spectrum which is a frequency spectrum of a power of the vibration signal, performing FFT processing on a third sound signal based on the first sound signal to calculate a sound signal power spectrum which is a frequency spectrum of a power of the third sound signal, and determining that the sound output from the speaker is abnormal in a case where a correlation between the vibration power spectrum and the sound signal power spectrum is small, and wherein when the first wireless transmission and reception device wirelessly transmits a sound signal to the second wireless transmission and reception device, the second wireless transmission and reception device receives the sound signal from the first wireless transmission and reception device, in a case where the correlation between the vibration power spectrum and the sound signal power spectrum is small, the second wireless transmission and reception device wirelessly transmits abnormal information indicating that the sound output from the speaker is abnormal to the first wireless transmission and reception device, and when the first wireless transmission and reception device receives the abnormal information, the first wireless transmission and reception device displays, on the display unit, a content of the received abnormal information.

(Configuration 13)

The wireless communication system as described in the configuration 12, characterized in that, when the vibration signal is processed in the FFT processing, the determination unit divides the vibration signal into multiple time periods, and calculates the vibration power spectrum for each of the multiple time periods, when the third sound signal is processed in the FFT processing, the determination unit divides the third sound signal into the multiple time periods, and calculates the sound signal power spectrum for each of the multiple time periods, and the determination unit includes:

a correlation coefficient calculation unit calculating, in each of the multiple time periods, a correlation coefficient between the vibration power spectrum and the sound signal power spectrum;

a correlation determination unit determining whether the correlation coefficient is equal to or more than the first value or not;

a sound signal power calculation unit calculating, for each of the plurality of time periods, a sound signal power which is the total power of the sound signal power spectrum;

a sound signal power determination unit determining whether the sound signal power is equal to or more than the second value or not;

a vibration output counter processing unit counting a number of times the correlation coefficient is equal to or more than the first value and the sound signal power is equal to or more than the second value, and outputs it as a first number of times; and a sound signal counter processing unit counting a number of times the sound signal power is equal to or more than the second value, and outputs it as a second number of times, in a case where the rate of the first number of times with respect to the second number of times is less than a predetermined threshold value, the sound output from the speaker is determined to be abnormal.

(Configuration 14)

The wireless communication system as described in the configuration 13, characterized in that, the determination unit includes:

a vibration power calculation unit calculating, for each of the plurality of time periods, a vibration power which is a total power of the vibration power spectrum; and a power ratio determination unit determining a vibration power ratio, which is a rate of the vibration power with respect to the sound signal power, is equal to or more than a third value or not, wherein the vibration output counter processing unit increases the first number of times, in a case where the correlation coefficient is equal to or more than the first value and the sound signal power is equal to or more than the second value and the vibration power ratio is equal to or more than the third value.

(Configuration 15)

The wireless communication system as described in the configuration 12, characterized in that, the speaker includes a driver unit converting a sound signal into a mechanical vibration and a protection cover protecting the vibration sensor, and the vibration sensor is attached to the driver unit, and the protection cover covers the vibration sensor and the driver unit.

(Configuration 16)

The wireless communication system according to configuration 13, wherein the first wireless transmission and reception device includes an operation unit receiving various kinds of commands and a sound input from an operator, and when a broadcast start is commanded with the operation unit, the first wireless transmission and reception device wirelessly transmits, to the second wireless transmission and reception device, a sound signal included in the broadcast and a broadcast start signal indicating a broadcast start, when an end of the broadcast is commanded with the operation unit, the first wireless transmission and reception device ends the sound signal transmission to the second wireless transmission and reception device, and wirelessly transmits a broadcast end signal indicating a broadcast end to the second wireless transmission and reception device, and in a case where a rate of a rate of the first number of times with respect to the second number of times is less than a predetermined threshold value after the second wireless transmission and reception device receives the broadcast start signal but before the second wireless transmission and reception device receives the broadcast end signal, the second wireless transmission and reception device determines that the sound output from the speaker is abnormal.

REFERENCE SIGNS LIST

100 . . . loudspeaker device, 101 . . . antenna, 102 . . . wireless unit, 103 . . . sound amplification unit, 110 . . . control unit, 111 . . . A/D converter, 112 . . . FFT processing unit, 112*a* . . . window processing unit, 112*b* . . . FFT calculation unit, 113 . . . sound signal power spectrum calculation unit, 114 . . . sound signal power calculation unit, 120 . . . channel processing unit, 121 . . . FFT processing unit, 121*a* . . . window processing unit, 121*b* . . . FFT calculation unit, 122 . . . vibration power spectrum calculation unit, 130 . . . comparison processing unit, 131 . . . correlation coefficient calculation unit, 132 . . . correlation determination unit, 133 . . . vibration power calculation unit, 134 . . . divider, 135 . . . power ratio determination unit,

136 . . . sound signal power determination unit, 137 . . . vibration output counter processing unit, 138 . . . divider, 139 . . . abnormality determination unit, 141 . . . sound signal counter processing unit, 142 . . . vibration power determination unit, 150 . . . vibration sensor unit, 151 . . . acceleration sensor, 152 . . . A/D converter, 160 . . . speaker, 161 . . . horn unit, 162 . . . driver unit, 163 . . . protection cover, 200 . . . master station, 210 . . . console desk, 211 . . . console desk control unit, 212 . . . operation display unit, 222 . . . wireless unit, 223 . . . antenna, 230 . . . comparison processing unit, 237 . . . vibration output counter processing unit, 330 . . . comparison processing unit, 339 . . . abnormality determination unit, 430 . . . comparison processing unit, 439 . . . abnormality determination unit, 530 . . . comparison processing unit, 539 . . . abnormality determination unit

DRAWINGS

Figure 9:
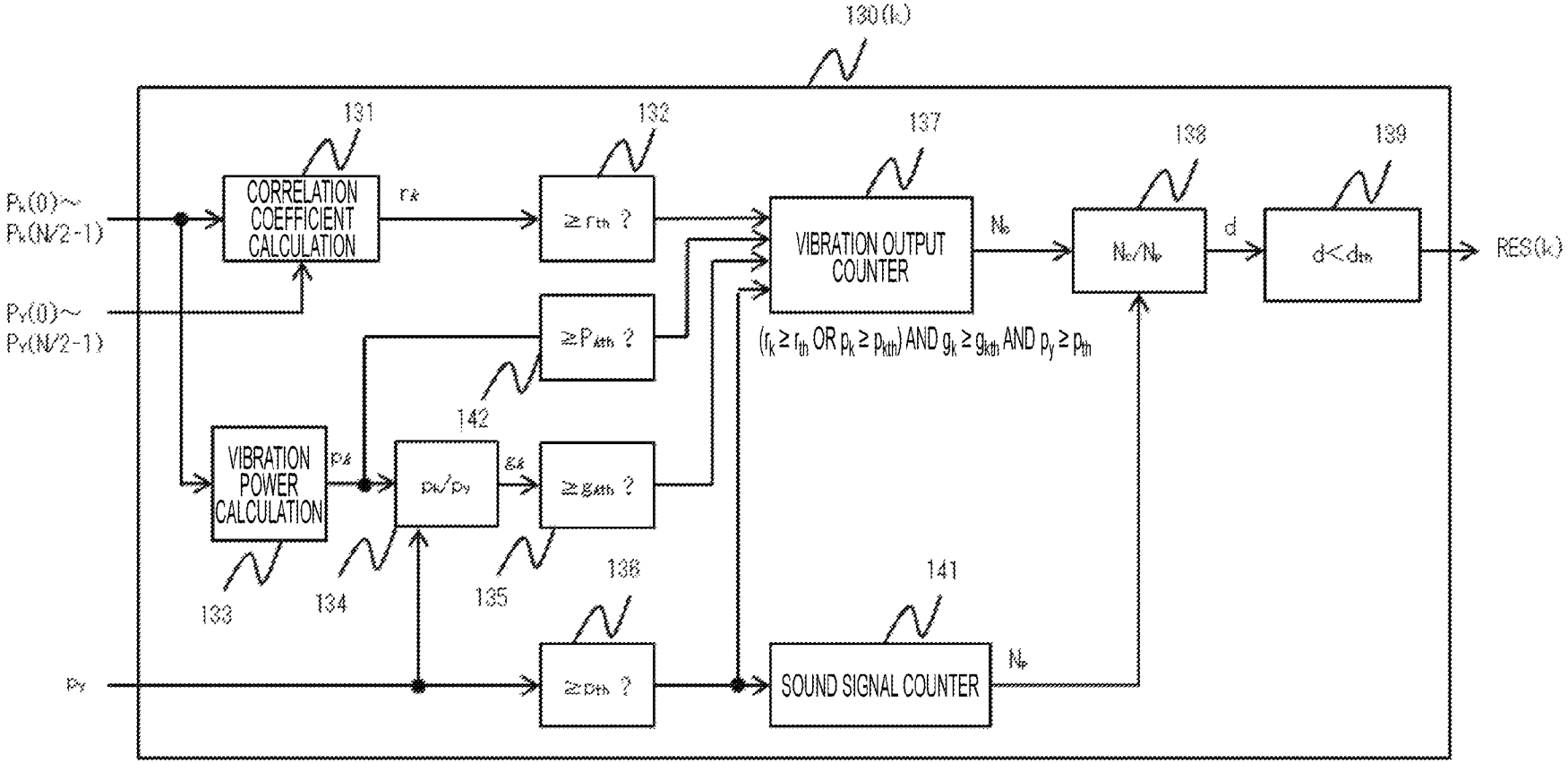
FIG. 9 is a configuration diagram illustrating a comparison processing unit according to a modification of the first embodiment of the present invention.

FIG. 1
100 LOUDSPEAKER DEVICE
102 WIRELESS UNIT
103 SOUND AMPLIFICATION UNIT
110 CONTROL UNIT
200 MASTER STATION
210 CONSOLE DESK
211 CONSOLE DESK CONTROL UNIT
212 OPERATION DISPLAY UNIT
222 WIRELESS UNIT
FIG. 3
110 CONTROL UNIT
112 FFT PROCESSING UNIT
112*a* WINDOW PROCESSING
112*b* FFT CALCULATION
113 SOUND SIGNAL POWER SPECTRUM CALCULATION
114 SOUND SIGNAL POWER CALCULATION
121 FFT PROCESSING UNIT
121*a* WINDOW PROCESSING
121*b* FFT CALCULATION
122 VIBRATION POWER SPECTRUM CALCULATION
130 COMPARISON PROCESSING
150 VIBRATION SENSOR UNIT
151(1) ACCELERATION SENSOR
151(M) ACCELERATION SENSOR AMPLIFICATION INPUT SIGNAL
FIG. 4
131 CORRELATION COEFFICIENT CALCULATION
133 VIBRATION POWER CALCULATION
137 VIBRATION OUTPUT COUNTER
($r_k \geq r_{th}$ AND $g_k \geq g_{kth}$ AND $p_y \geq p_{th}$)
141 SOUND SIGNAL COUNTER
139 ABNORMALITY DETERMINATION UNIT
FIG. 5
131 CORRELATION COEFFICIENT CALCULATION
237 VIBRATION OUTPUT COUNTER
($r_k \geq r_{th}$ AND $p_y \geq p_{th}$)
141 SOUND SIGNAL COUNTER
FIG. 6
131 CORRELATION COEFFICIENT CALCULATION
339 ABNORMALITY DETERMINATION UNIT
FIG. 7
131 CORRELATION COEFFICIENT CALCULATION
133 VIBRATION POWER CALCULATION
439 ABNORMALITY DETERMINATION UNIT
FIG. 8
131 CORRELATION COEFFICIENT CALCULATION
FIG. 9
131 CORRELATION COEFFICIENT CALCULATION
133 VIBRATION POWER CALCULATION
141 SOUND SIGNAL COUNTER
137 VIBRATION OUTPUT COUNTER
($r_k \geq r_{th}$ OR $p_k \geq p_{kth}$) AND $g_k \geq g_{kth}$ AND $p_y \geq p_{th}$

The invention claimed is:

1. A loudspeaker device comprising:

a receiver that receives a sound signal and outputs the received sound signal as a first sound signal;

a sound amplifier that amplifies the first sound signal and outputs the amplified first sound signal as a second sound signal;

a speaker that outputs a sound on a basis of the second sound signal;

a vibration sensor, attached to the speaker, that detects a vibration of the speaker and outputs a vibration signal to a CPU;

wherein the CPU:

performs FFT processing on the vibration signal to calculate a vibration power spectrum, the vibration power spectrum including a frequency spectrum of a power of the vibration signal, performs the FFT processing on a third sound signal based on the first sound signal to calculate a sound signal power spectrum, the sound signal power spectrum including a frequency spectrum of a power of the third sound signal, determines whether the sound output from the speaker is normal or abnormal on a basis of a correlation between the vibration power spectrum and the sound signal power spectrum, and outputs a result of the determination of whether the sound output from the speaker is normal or abnormal.

2. The loudspeaker device according to claim 1, wherein the CPU includes:

a correlation coefficient calculation unit calculating a correlation coefficient between the vibration power spectrum and the sound signal power spectrum;

a correlation determination unit determining whether the correlation coefficient is equal to or more than a first value;

a sound signal power calculation unit calculating a sound signal power, the sound signal power including a total power of the sound signal power spectrum; and a sound signal power determination unit determining whether the sound signal power is equal to or more than a second value, wherein in response to the sound signal power is equal to or more than the second value, and the correlation coefficient is less than the first value, determining that the sound output from the speaker is abnormal.

3. The loudspeaker device according to claim 2, wherein the CPU divides the vibration signal into a plurality of time periods when the FFT processing is performed on the vibration signal, calculates the vibration power spectrum for each of the plurality of time periods, divides the third sound signal into a plurality of time periods when the FFT processing is performed on the third sound signal, and calculates the sound signal power spectrum for each of the plurality of time periods, wherein the correlation coefficient calculation unit calculates the correlation coefficient for each of the plurality of time periods, wherein the sound signal power calculation unit calculates the sound signal power for each of the plurality of time periods, wherein a number of times the correlation coefficient is equal to or more than the first value and the sound signal power is equal to or more than the second value is counted as a first number of times, wherein a number of times the sound signal power is equal to or more than the second value is counted as a second number of times, and wherein in a case where a rate of the first number of times with respect to the second number of times is less than a predetermined threshold value, the sound output from the speaker is determined to be abnormal.

4. The loudspeaker device according to claim 3, wherein the CPU includes:

a vibration power calculation unit that calculates, for each of the plurality of time periods, a vibration power, the vibration power including a total power of the vibration power spectrum of each of the time periods; and a power ratio determination unit that determines whether a vibration power ratio is equal to or more than a third value, the vibration power ratio including a rate of the vibration power with respect to the sound signal power, wherein in response to the correlation coefficient is equal to or more than the first value, the sound signal power is equal to or more than the second value, and the vibration power ratio is equal to or more than the third value, the first number of times is increased.

5. The loudspeaker device according to claim 1, wherein the speaker includes:

a driver unit that converts a sound signal into a mechanical vibration; and a protection cover that protects the vibration sensor, wherein the vibration sensor is attached to the driver unit, and the protection cover covers the vibration sensor and the driver unit.

6. The loudspeaker device according to claim 1, wherein a first speaker and a second speaker are provided as the speaker, and a first vibration sensor attached to the first speaker and a second vibration sensor attached to the second speaker are provided as the vibration sensor, wherein the CPU includes:

a first vibration power spectrum calculation unit that performs FFT processing on the vibration signal from the first vibration sensor, and calculates the vibration power spectrum as a first vibration power spectrum; and a second vibration power spectrum calculation unit that performs FFT processing on the vibration signal from the second vibration sensor, and calculates the vibration power spectrum as a second vibration power spectrum, wherein in response to a correlation between the first vibration power spectrum and the sound signal power spectrum is small, determining that a sound output from the first speaker is abnormal, and wherein in response to a correlation between the second vibration power spectrum and the sound signal power spectrum is small, determining that a sound output from the second speaker is abnormal.

7. The loudspeaker device according to claim 1, wherein the third sound signal includes a sound signal before amplification by the sound amplifier.

8. The loudspeaker device according to claim 1, wherein the CPU includes:

a correlation coefficient calculation unit that calculates a correlation coefficient between the vibration power spectrum and the sound signal power spectrum;

a correlation determination unit that determines whether the correlation coefficient is equal to or more than a first value;

a sound signal power calculation unit that calculates a sound signal power which is a total power of the sound signal power spectrum;

a vibration power calculation unit that calculates a vibration power which is a total power of the vibration power spectrum; and a power ratio determination unit that determines whether a vibration power ratio is equal to or more than a third value, the vibration power ration including a rate of the vibration power with respect to the sound signal power, wherein in response to the correlation coefficient is equal to or more than the first value and the vibration power ratio is less than the third value, determining that the sound output from the speaker is abnormal.

9. A wireless communication system comprising:

a first wireless transmission and reception device that wirelessly transmits a sound signal; and a second wireless transmission and reception device that receives the sound signal wirelessly transmitted from the first wireless transmission and reception device and outputs a sound on a basis of the received sound signal;

wherein the first wireless transmission and reception device includes:

a display unit that displays various kinds of information, and a first wireless transmission and reception unit that performs wireless transmission and reception to and from the second wireless transmission and reception device;

wherein the second wireless transmission and reception device includes:

a second wireless transmission and reception unit that performs wireless transmission and reception to and from the first wireless transmission and reception device, and receives the sound signal wirelessly transmitted from the first wireless transmission and reception device to output the received sound signal as a first sound signal, a sound amplifier that amplifies the first sound signal and outputs the amplified first sound signal as a second sound signal, a speaker that outputs a sound on a basis of the second sound signal, a vibration sensor attached to the speaker that detects a vibration of the speaker and outputs a vibration signal to a CPU, and wherein the CPU:

performs FFT processing on the vibration signal to calculate a vibration power spectrum, the vibration power spectrum including a frequency spectrum of a power of the vibration signal, performs FFT processing on a third sound signal based on the first sound signal to calculate a sound signal power spectrum, the sound signal power spectrum including a frequency spectrum of a power of the third sound signal, determines whether the sound output from the speaker is normal or abnormal, on a basis of a correlation between the vibration power spectrum and the sound signal power spectrum, and outputs a result of the determination of whether the sound output from the speaker is normal or abnormal to the second wireless transmission and reception unit;

wherein when the first wireless transmission and reception device wirelessly transmits the sound signal to the second wireless transmission and reception device, the second wireless transmission and reception device receives the sound signal from the first wireless transmission and reception device, and in response to a correlation between the vibration power spectrum and the sound signal power spectrum is small, the second wireless transmission and reception device wirelessly transmits, to the first wireless transmission and reception device, abnormal information indicating that the sound output from the speaker is abnormal, and wherein when the first wireless transmission and reception device receives the abnormal information, the first wireless transmission and reception device displays, on the display unit, a content of the received abnormal information.

10. The wireless communication system according to claim 9, wherein the first wireless transmission and reception device includes an operation unit that receives a plurality of commands and a sound input from an operator, wherein when a start of a broadcast is commanded by the operation unit, the first wireless transmission and reception device wirelessly transmits, to the second wireless transmission and reception device, a sound signal included in the broadcast and a broadcast start signal indicating the start of the broadcast, wherein when an end of the broadcast is commanded by the operation unit, the first wireless transmission and reception device ends the sound signal transmission to the second wireless transmission and reception device, and wirelessly transmits a broadcast end signal indicating the end of the broadcast to the second wireless transmission and reception device, and wherein in response to a rate of the first number of times with respect to a second number of times is less than a predetermined threshold value after the second wireless transmission and reception device receives the broadcast start signal but before the second wireless transmission and reception device receives the broadcast end signal, the second wireless transmission and reception device determines that the sound output from the speaker is abnormal.

* * * * *